US011814922B2

(12) United States Patent
Barbee et al.

(10) Patent No.: US 11,814,922 B2
(45) **Date of Patent: *Nov. 14, 2023**

(54) METHOD AND APPARATUS FOR DROPPING A PUMP DOWN PLUG OR BALL

(71) Applicant: GULFSTREAM SERVICES, INC., Houma, LA (US)

(72) Inventors: Phil Barbee, Gretna, LA (US); Michael Mire, Kenner, LA (US); Joey Naquin, Houma, LA (US)

(73) Assignee: Gulfstream Services, Inc., Houma, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/892,554

(22) Filed: Aug. 22, 2022

(65) Prior Publication Data

US 2023/0050637 A1 Feb. 16, 2023

Related U.S. Application Data

(63) Continuation of application No. 17/166,999, filed on Feb. 3, 2021, now Pat. No. 11,459,845, which is a (Continued)

(51) Int. Cl.
*E21B 33/068* (2006.01)
*E21B 34/02* (2006.01)
(Continued)

(52) U.S. Cl.
CPC ..... *E21B 33/068* (2013.01); *E21B 33/05* (2013.01); *E21B 33/12* (2013.01); *E21B 33/134* (2013.01);
(Continued)

(58) Field of Classification Search
CPC ..... E21B 34/02; E21B 33/16; E21B 33/068; E21B 33/167
See application file for complete search history.

(56) References Cited

U.S. PATENT DOCUMENTS 8,651,174 B2 * 2/2014 Barbee ..... E21B 33/14 166/70
8,997,850 B2 * 4/2015 Barbee ..... E21B 33/167 166/70
(Continued)

*Primary Examiner* — Giovanna Wright
(74) *Attorney, Agent, or Firm* — Garvey, Smith & Nehrbass, Patent Attorneys, L.L.C.; Charles C. Garvey, Jr.; Julie Rabalais Chauvin

(57) ABSTRACT

An improved method and apparatus for dropping a ball, plug or dart during oil and gas well operations (e.g., cementing operations) employs a specially configured tool body assembly having valving members (e.g., safety or kelly values) and valving members holding plugs, balls, or darts to be dropped. In one embodiment, the ball(s), dart(s) or plug(s) are contained in a sliding sleeve that shifts position responsive to valve rotation. An optional indicator indicates to a user or operator that a ball or plug has passed a selected one of the valving members. A transmitter (or transceiver) provides an ability to generate a wireless signal that is received by receivers (or transceivers) on the tool body assembly. Each receiver (or transceiver) controls an electrical actuator that engages a valving member or the indicator. Wireless signals can be used to open or close a valve or to reset a "tripped" indicator.

20 Claims, 36 Drawing Sheets

Related U.S. Application Data continuation of application No. 16/718,442, filed on Dec. 18, 2019, now Pat. No. 10,947,807, which is a continuation of application No. 16/238,765, filed on Jan. 3, 2019, now Pat. No. 10,550,661, which is a continuation of application No. 15/632,833, filed on Jun. 26, 2017, now Pat. No. 10,208,556, which is a continuation of application No. 15/156,723, filed on May 17, 2016, now Pat. No. 9,689,226, which is a continuation of application No. 14/618,749, filed on Feb. 10, 2015, now Pat. No. 9,341,040, which is a continuation of application No. 14/181,255, filed on Feb. 14, 2014, now Pat. No. 8,997,850, which is a continuation of application No. 13/080,397, filed on Apr. 5, 2011, now Pat. No. 8,651,174, which is a continuation-in-part of application No. 12/349,109, filed on Jan. 6, 2009, now Pat. No. 7,918,278, which is a continuation-in-part of application No. 11/951,802, filed on Dec. 6, 2007, now Pat. No. 7,841,410, which is a continuation-in-part of application No. 11/749,591, filed on May 16, 2007, now Pat. No. 7,607,481.

(60) Provisional application No. 61/334,965, filed on May 14, 2010.

(51) Int. Cl.

| | |
|---|---|
| ***E21B 33/16*** | (2006.01) |
| ***E21B 33/05*** | (2006.01) |
| ***E21B 33/134*** | (2006.01) |
| ***E21B 33/14*** | (2006.01) |
| ***E21B 33/12*** | (2006.01) |

(52) U.S. Cl.

CPC ..... *E21B 33/14* (2013.01); *E21B 33/16* (2013.01); *E21B 33/167* (2020.05); *E21B 34/02* (2013.01); *E21B 2200/04* (2020.05)

(56) References Cited

U.S. PATENT DOCUMENTS

| | | | | |
|---|---|---|---|---|
| 9,341,040 | B2 * | 5/2016 | Barbee | E21B 34/02 |
| 10,208,556 | B2 * | 2/2019 | Barbee | E21B 33/134 |
| 10,550,661 | B2 * | 2/2020 | Barbee | E21B 33/05 |
| 10,947,807 | B2 * | 3/2021 | Barbee | E21B 33/12 |

* cited by examiner

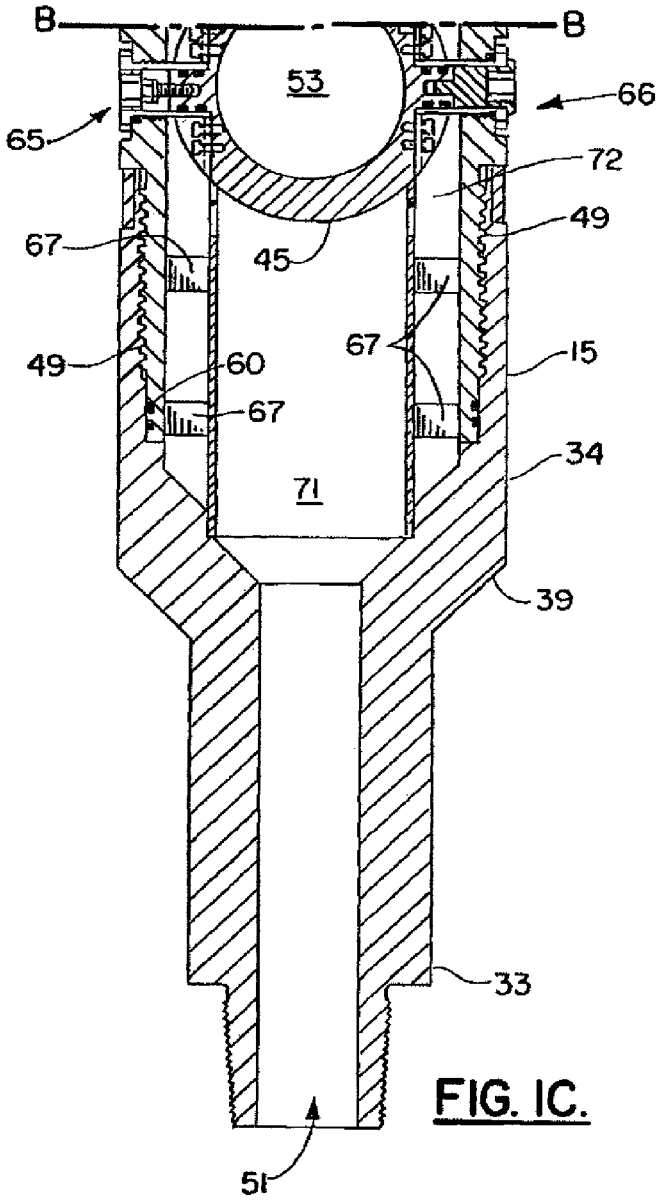
FIG. IC.

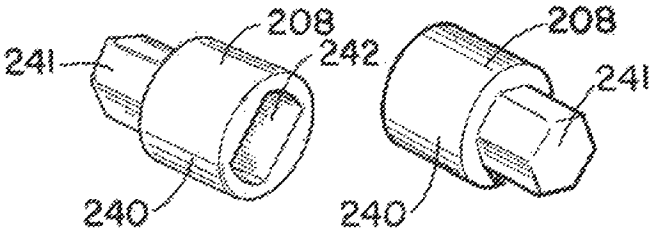
FIG. 43.
FIG. 44.
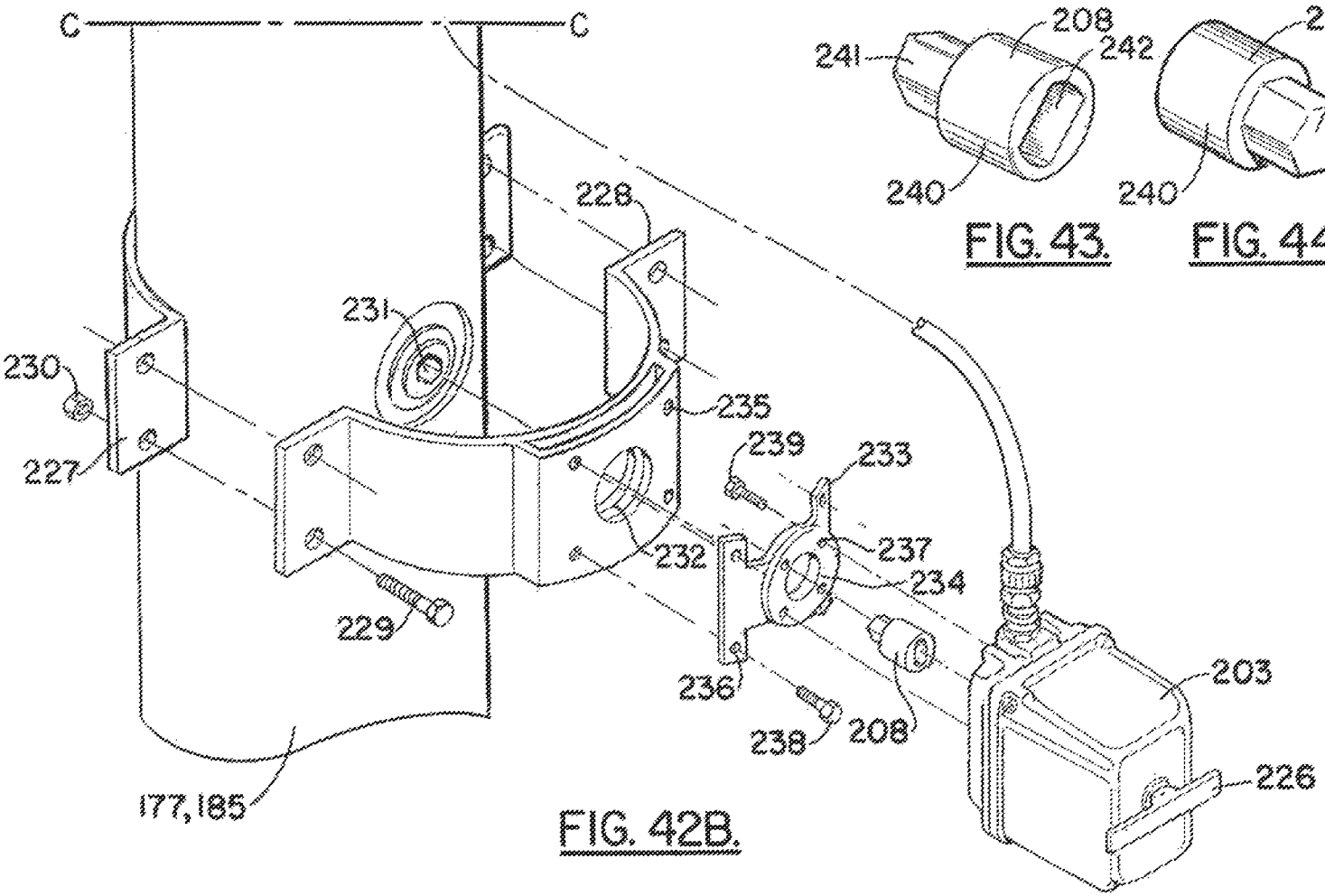
FIG. 42B.

METHOD AND APPARATUS FOR DROPPING A PUMP DOWN PLUG OR BALL

CROSS-REFERENCE TO RELATED APPLICATIONS

This is a continuation of U.S. patent application Ser. No. 17/166,999, filed Feb. 3, 2021 (issued as U.S. Pat. No. 11,459,845 on Oct. 4, 2022), which is a continuation of U.S. patent application Ser. No. 16/718,442, filed Dec. 18, 2019 (issued as U.S. Pat. No. 10,947,807 on Mar. 16, 2021), which is a continuation of U.S. patent application Ser. No. 16/238,765, filed Jan. 3, 2019 (issued as U.S. Pat. No. 10,550,661 on Feb. 4, 2020), which is a continuation of U.S. patent application Ser. No. 15/632,833, filed Jun. 26, 2017 (issued as U.S. Pat. No. 10,208,556 on Feb. 19, 2019), which is a continuation of U.S. patent application Ser. No. 15/156,723, filed May 17, 2016 (issued as U.S. Pat. No. 9,689,226 on Jun. 27, 2017), which is a continuation of U.S. patent application Ser. No. 14/618,749, filed Feb. 10, 2015 (issued as U.S. Pat. No. 9,341,040 on May 17, 2016), which is a continuation of U.S. patent application Ser. No. 14/181,255, filed Feb. 14, 2014 (issued as U.S. Pat. No. 8,997,850 on Apr. 7, 2015) which is a continuation of U.S. patent application Ser. No. 13/080,397, filed Apr. 5, 2011 (issued as U.S. Pat. No. 8,651,174 on Feb. 18, 2014), which claims the benefit of U.S. Provisional Patent Application Ser. No. 61/334,965, filed May 14, 2010, each of which is hereby incorporated herein by reference and priority to each of which is hereby claimed.

Priority of U.S. Provisional Patent Application Ser. No. 61/334,965, filed May 14, 2010, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus that is of particular utility in cementing operations associated with oil and gas well exploration and production. More specifically the present invention provides an improvement to cementing operations and related operations employing a plug or ball dropping head.

2. General Background of the Invention

Patents have issued that relate generally to the concept of using a plug, dart or a ball that is dispensed or dropped into the well or "down hole" during oil and gas well drilling and production operations, especially when conducting cementing operations. The following possibly relevant patents are incorporated herein by reference. The patents are listed numerically. The order of such listing does not have any significance.

TABLE

| PAT. NO. | TITLE | ISSUE DATE MM-DD-YYYY |
|---|---|---|
| 3,828,852 | Apparatus for Cementing Well Bore Casing | 08-13-1974 |
| 4,427,065 | Cementing Plug Container and Method of Use Thereof | 01-24-1984 |
| 4,617,960 | Verification of a Surface Controlled Subsurface Actuating Device | 10-21-1986 |
| 4,624,312 | Remote Cementing Plug Launching System | 11-25-1986 |
| 4,670,875 | Multiplexed Dual Tone Multi-Frequency Encoding/Decoding System for Remote Control Applications | 06-02-1987 |
| 4,671,353 | Apparatus for Releasing a Cementing Plug | 06-09-1987 |
| 4,722,389 | Well Bore Servicing Arrangement | 02-02-1988 |
| 4,782,894 | Cementing Plug Container with Remote Control System | 11-08-1988 |
| 4,854,383 | Manifold Arrangement for use with a Top Drive Power Unit | 08-08-1989 |
| 4,995,457 | Lift-Through Head and Swivel | 02-26-1991 |
| 5,014,596 | Remote Control Modification for Manually Controlled Hydraulic Systems | 05-14-1991 |
| 5,095,988 | Plug Injection Method and Apparatus | 03-17-1992 |
| 5,146,153 | Wireless Control System | 09-08-1992 |
| 5,236,035 | Swivel Cementing Head with Manifold Assembly | 08-17-1993 |
| 5,265,271 | Low Battery Detector | 11-23-1993 |
| 5,293,933 | Swivel Cementing Head with Manifold Assembly Having Remove Control Valves and Plug Release Plungers | 03-15-1994 |
| 5,435,390 | Remote Control for a Plug-Dropping Head | 07-25-1995 |
| 5,590,713 | Remote control for well tool | 01-07-1997 |
| 5,758,726 | Ball Drop Head With Rotating Rings | 06-02-1998 |
| 5,833,002 | Remote Control Plug-Dropping Head | 11-10-1998 |
| 5,856,790 | Remote Control for a Plug-Dropping Head | 01-05-1999 |
| 5,960,881 | Downhole Surge Pressure Reduction System and Method of Use | 10-05-1999 |
| 6,142,226 | Hydraulic Setting Tool | 11-07-2000 |
| 6,182,752 | Multi-Port Cementing Head | 02-06-2001 |
| 6,390,200 | Drop Ball Sub and System of Use | 05-21-2002 |
| 6,575,238 | Ball and Plug Dropping Head | 06-10-2003 |
| 6,672,384 | Plug-Dropping Container for Releasing a Plug Into a Wellbore | 01-06-2004 |
| 6,904,970 | Cementing Manifold Assembly | 06-14-2005 |
| 7,066,249 | Cementing Manifold Assembly | 06-27-2006 |
| 7,607,481 | Method and apparatus for dropping a pump down plug or ball | 10-27-2009 |
| 7,841,410 | Method and apparatus for dropping a pump down plug or ball | 11-30-2010 |
| 7,918,278 | Method and Apparatus for Dropping A Pump Down Plug or Ball | 04-05-2011 |

There is more information about remote control pump down plug or ball dropping in the file histories of U.S. Pat. Nos. 5,435,390, 5,590,713, 5,833,002, and 5,856,790, and each of which is currently undergoing Ex Parte Reexamination:

Control No. 90/011,188, filed Aug. 27, 2010 (Reexamination of U.S. Pat. No. 5,435,390);

Control No. 90/011,189, filed Aug. 27, 2010 (Reexamination of U.S. Pat. No. 5,590,713);

Control No. 90/011,190, filed Aug. 27, 2010 (Reexamination of U.S. Pat. No. 5,833,002); and Control No. 90/011,191, filed Aug. 27, 2010 (Reexamination of U.S. Pat. No. 5,856,790).

BRIEF SUMMARY OF THE INVENTION

The present invention provides an improved method and apparatus for use in cementing and like operations, employing a plug or ball dropping head of improved configuration.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 1A, 1B, 1C are partial, sectional, elevation views of a preferred embodiment of the apparatus of the present invention wherein line A-A of FIG. 1A matches line A-A of FIG. 1B, and line B-B of FIG. 1B matches line B-B of FIG. 1C;

FIGS. 42A, 42B are fragmentary perspective views of a fourth embodiment of the apparatus of the present invention;

FIG. 43 is a fragmentary view of a fourth embodiment of the apparatus of the present invention;

FIG. 44 is a fragmentary view of a fourth embodiment of the apparatus of the present invention;

DETAILED DESCRIPTION OF THE INVENTION

Figure 9:
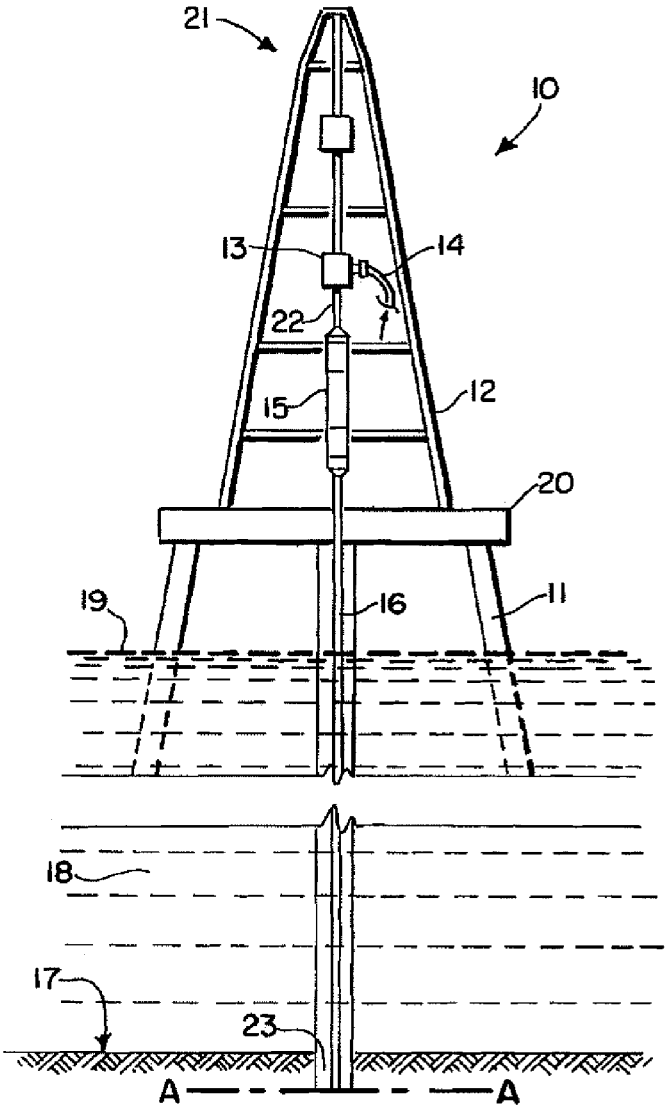
FIG. 9 is an elevation view of a preferred embodiment of the apparatus of the present invention and illustrating the method of the present invention.

FIG. 9 shows generally an oil well drilling structure 10 that can provide a platform 11 such as a marine platform as shown. Such platforms 11 are well known. Platform 11 supports a derrick 12 that can be equipped with a lifting device 21 that supports a top drive unit 13. Such a derrick 12 and top drive unit 13 are well known. A top drive unit 13 can be seen for example in U.S. Pat. Nos. 4,854,383 and 4,722,389 which are incorporated herein by reference.

A flow line 14 can be used for providing a selected fluid such as a fluidized cement or fluidized setable material to be pumped into the well during operations which are known in the industry and are sometimes referred to as cementing operations. Such cementing operations are discussed for example in prior U.S. Pat. Nos. 3,828,852; 4,427,065; 4,671,353; 4,782,894; 4,995,457; 5,236,035; 5,293,933; and 6,182,752, each of which is incorporated herein by reference.

A tubular member 22 can be used to support plug dropping head 15 at a position below top drive unit 13 as shown in FIG. 9. String 16 is attached to the lower end portion of plug dropping head 15.

In FIG. 9, the platform 11 can be any oil and gas well drilling platform 11 such as a marine platform shown in a body of water 18 that provides a seabed or mud line 17 and water surface 19. Such a platform 11 provides a platform deck 20 that affords space for well personnel to operate and for the storage of equipment and supplies that are needed for the well drilling operation.

Figure 10:
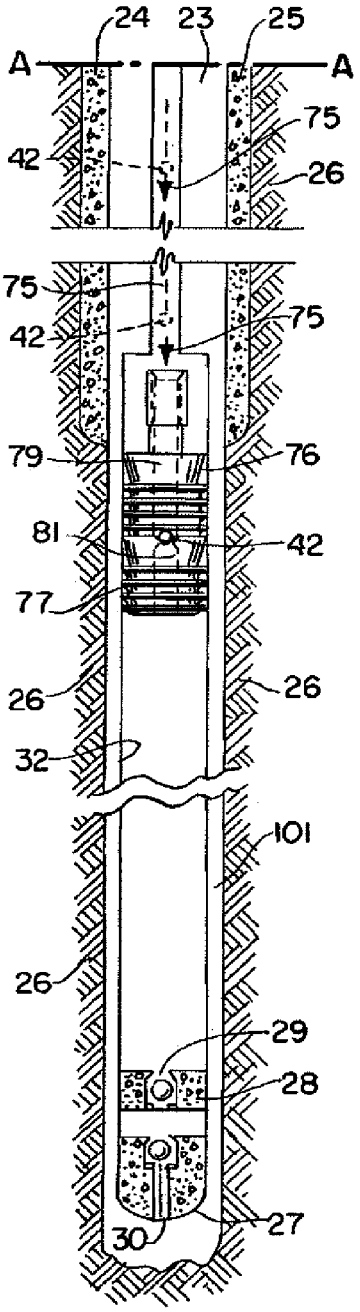
FIG. 10 is a sectional, elevation view illustrating part of the method of the present invention and wherein line A-A of FIG. 10 matches line A-A of FIG. 9.
Figure 11:
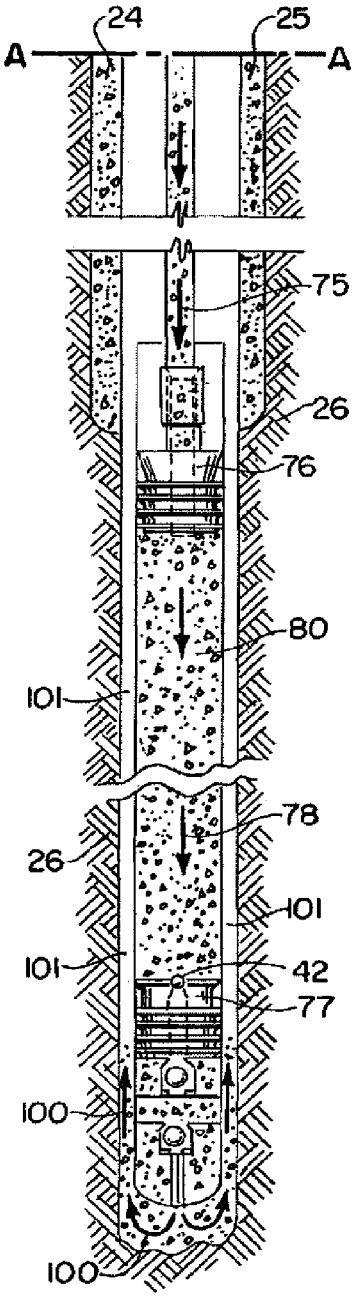
FIG. 11 is a sectional, elevation view illustrating part of the method of the present invention and wherein line A-A of FIG. 11 matches line A-A of FIG. 9.

A well bore 23 extends below mud line 17. In FIGS. 10 and 11, the well bore 23 can be surrounded with a surface casing 24. The surface casing 24 can be surrounded with cement/concrete 25 that is positioned in between a surrounding formation 26 and the surface casing 24. Similarly, a liner or production casing 32 extends below surface casing 24. The production casing 32 has a lower end portion that can be fitted with a casing shoe 27 and float valve 28 as shown in FIGS. 10-16. Casing shoe 27 has passageway 30. Float valve 28 has passageway 29.

Figure 1A:
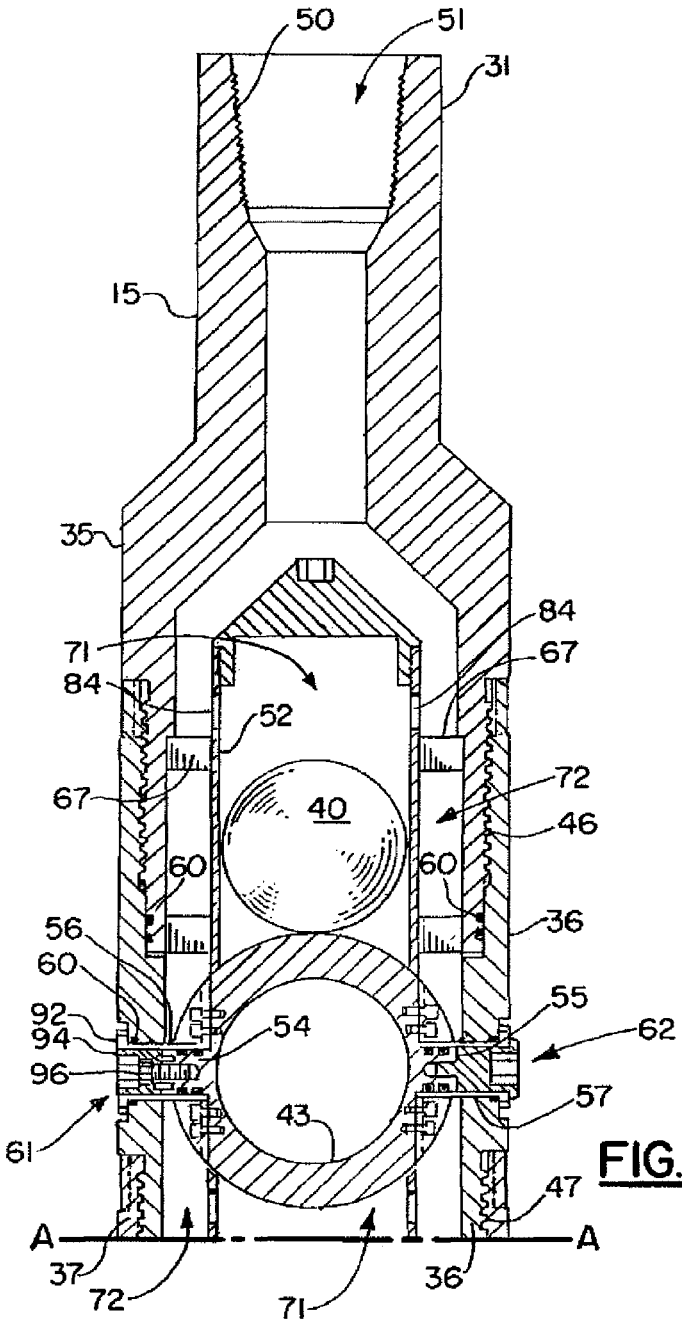
Figure 1B:
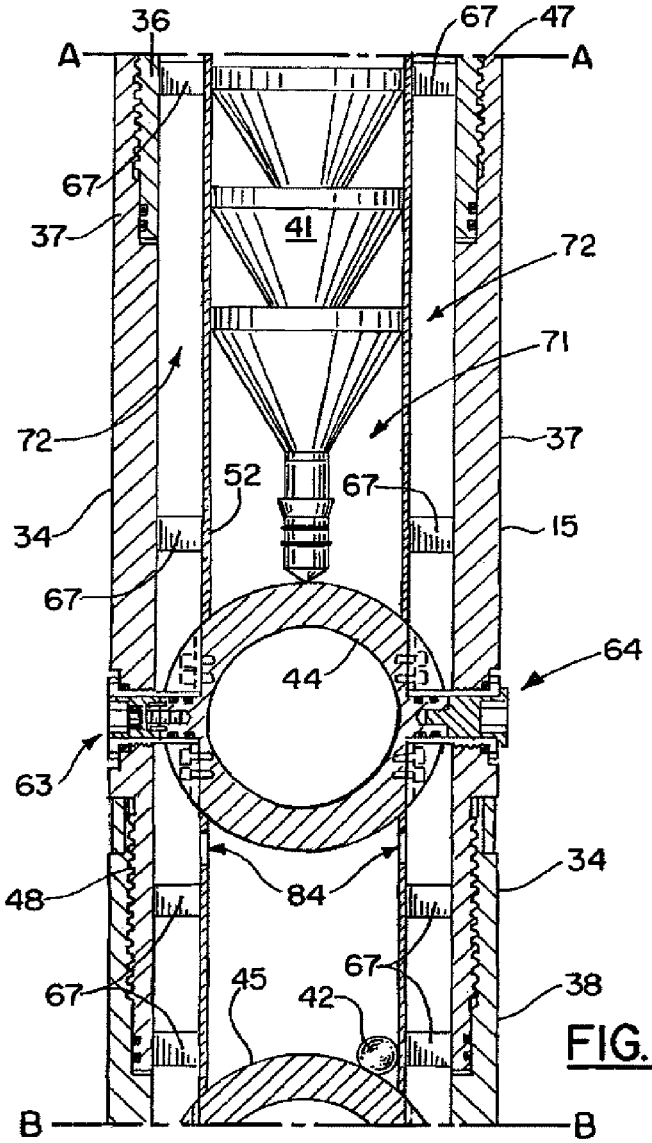
Figure 2:
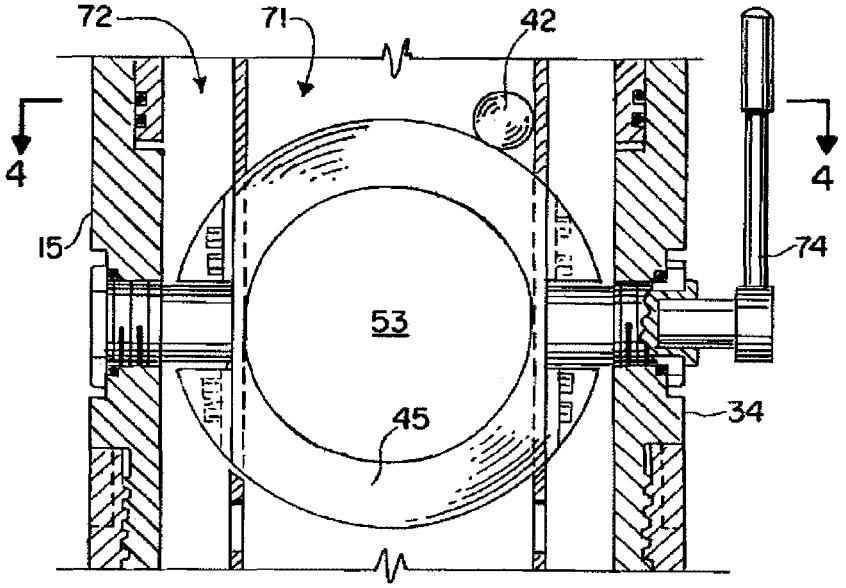
FIG. 2 is a partial, sectional, elevation view of a preferred embodiment of the apparatus of the present invention.

The present invention provides an improved method and apparatus for dropping balls, plugs, darts or the like as a part of a cementing operation. Such cementing operations are in general known and are employed for example when installing a liner such as liner 32. In the drawings, arrows 75 indicate generally the flow path of fluid (e.g. cement, fluidized material or the like) through the tool body 34. In that regard, the present invention provides an improved ball or plug or dart dropping head 15 that is shown in FIGS. 1-8, 10-17 and 18-33. In FIGS. 1A, 1B, 1C and 2-8, ball/plug dropping head 15 has an upper end portion 31 and a lower end portion 33. Ball/plug dropping head 15 provides a tool body 34 that can be of multiple sections that are connected together, such as with threaded connections. In FIGS. 1A-1C, the tool body 34 includes sections 35, 36, 37, 38, 39. The section 35 is an upper section. The section 39 is a lower section.

Ball/plug dropping head 15 can be pre-loaded with a number of different items to be dropped as part of a cementing operation. For example, in FIGS. 1A, 1B, 1C there are a number of items that are contained in ball/plug dropping head 15. These include an upper, larger diameter ball dart 40, 41 and smaller diameter ball 42. In FIGS. 18-26, an alternate embodiment is shown which enables very small diameter balls, sometimes referred to as "frac-balls" 102 (which can have a diameter of between about ½ and ⅝ inches) to be dispensed into the well below toll body 34.

The tool body 34 supports a plurality of valving members at opposed openings 90. The valving members can include first valving member 43 which is an upper valving member. The valving members can include a second valving member 44 which is in between the first valving member 43 and a lower or third valving member 45. Valving member 43 attaches to tool body 34 at upper opening positions 61, 62. Valving member 44 attaches to tool body 34 at middle opening positions 63, 64. Valving member 45 attaches to tool body 43 at lower opening positions 65, 66.

Threaded connections 46, 47, 48, 49 can be used for connecting the various body sections 35, 36, 37, 38, 39 together end to end as shown in FIGS. 1A, 1B, 1C. Tool body 34 upper end 31 is provided with an internally threaded portion 50 for forming a connection with tubular member 22 that depends from top drive unit 13 as shown in FIG. 9. A flow bore 51 extends between upper end 31 and lower end 33 of tool body 34.

Sleeve sections 52 are secured to tool body 34 within bore 15 as shown in FIGS. 1A, 1B, 1C. Sleeves 52 can be generally centered within bore 51 as shown in FIGS. 1A, 1B, 1C using spacers 67 that extend along radial lines from the sections 35-39.

Each valving member 43, 44, 45 is movable between open and closed positions. In FIGS. 1A, 1B, 1C each of the valving members 43, 44, 45 is in a closed position. In that closed position, each valving member 43, 44, 45 prevents downward movement of a plug, ball 40, 42, or dart 41 as shown. In FIG. 1A, the closed position of valving member 43 prevents downward movement of larger diameter ball 40. Similarly, in FIG. 1B, a closed position of valving member 44 prevents a downward movement of dart 41. In FIG. 1B, a closed position of valving member 45 prevents a downward movement of smaller diameter ball 42. In each instance, the ball, dart or plug rests upon the outer curved surface 68 of valving member 43, 44 or 45 as shown in the drawings.

Figure 3:
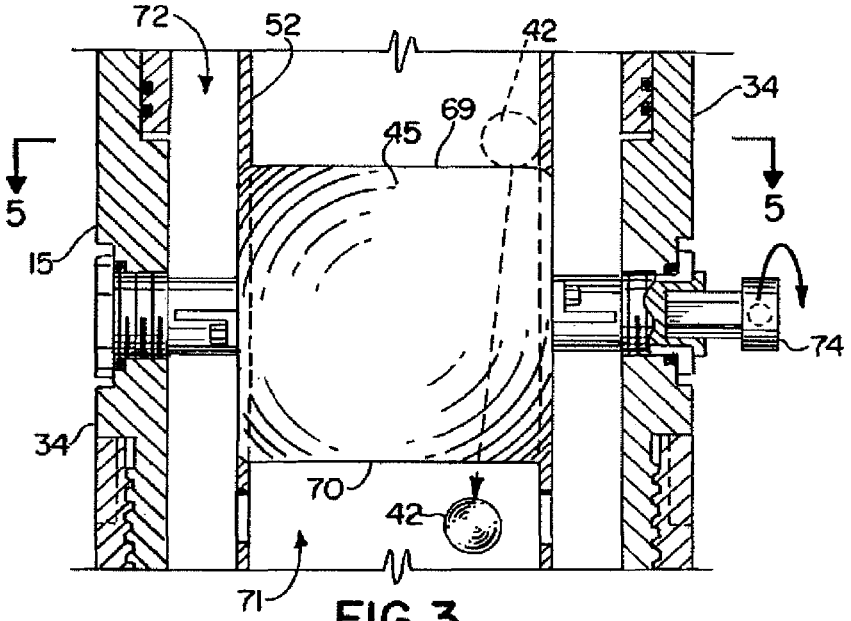
FIG. 3 is a partial, sectional, elevation view of a preferred embodiment of the apparatus of the present invention.
Figure 6:
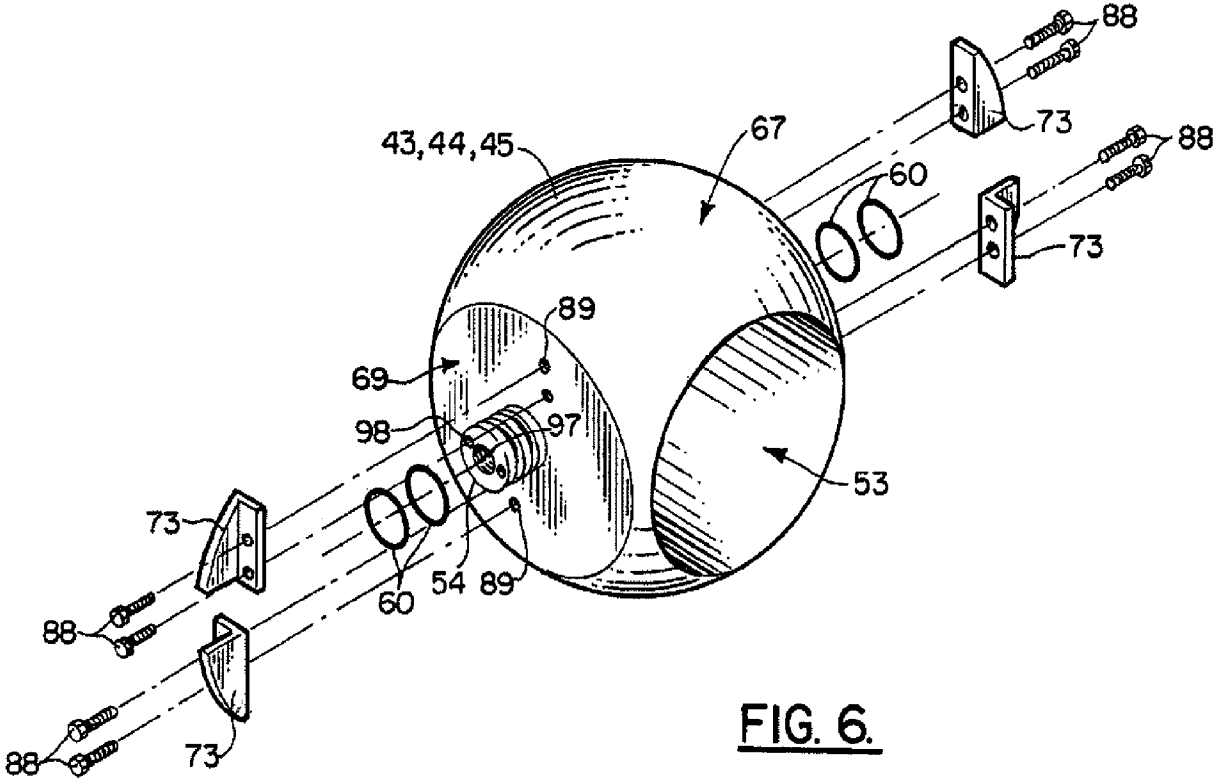
FIG. 6 is a partial perspective view of a preferred embodiment of the apparatus of the present invention.
Figure 17:
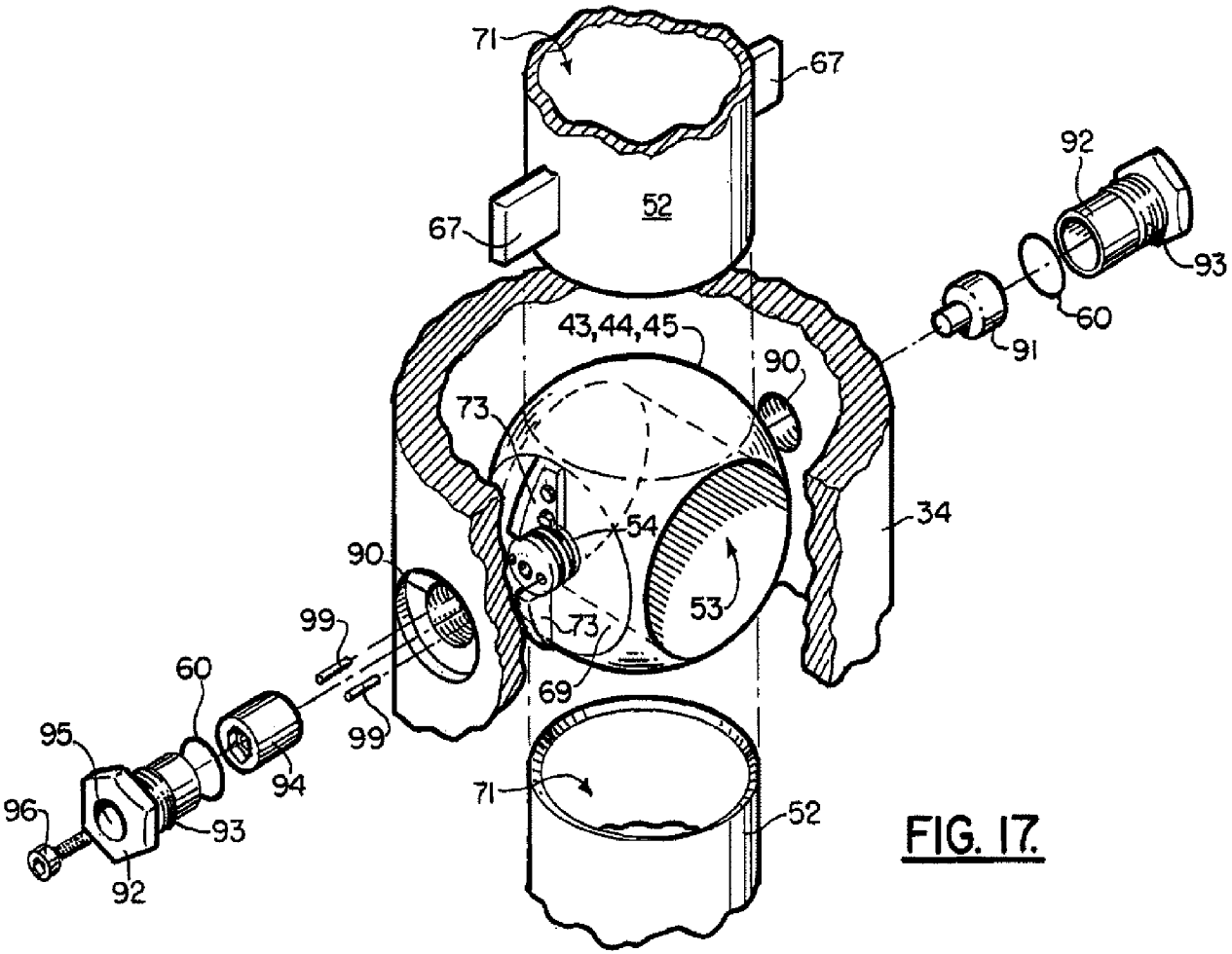
FIG. 17 is a partial perspective view of a preferred embodiment of the apparatus of the present invention.
Figure 18:
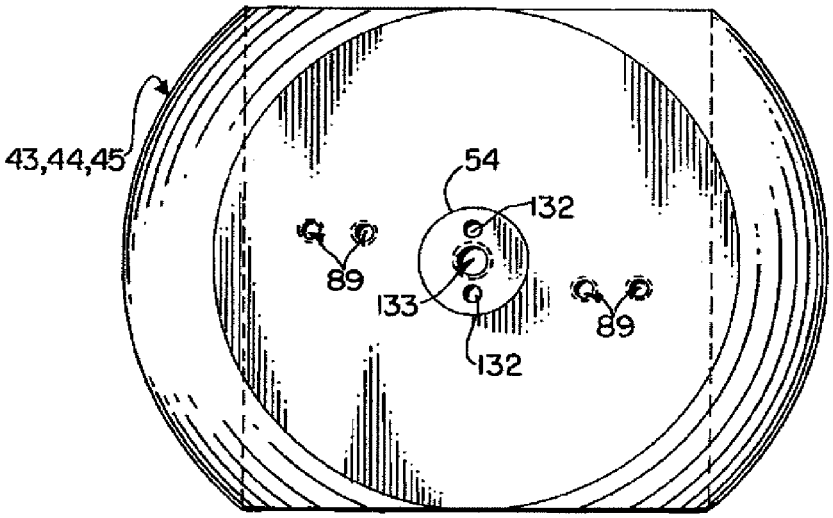
FIG. 18 is a partial view of a second embodiment of the apparatus of the present invention and showing a ball valving member.

Each valving member 43, 44, 45 provides a pair of opposed generally flat surfaces 69, 70 (see FIGS. 3, 6, 17). FIG. 17 shows in more detail the connection that is formed between each of the valving members 43, 44, 45 and the tool body 34. The tool body 34 provides opposed openings 90 that are receptive the generally cylindrically shaped valve stems 54, 55 that are provided on the flat sections or flat surfaces 69, 70 of each valving member 43, 44, 45. For example, in FIGS. 6 and 17, the flat surface 69 provides valve stem 54. Openings 90 are receptive of the parts shown in exploded view in FIG. 17 that enable a connection to be formed between the valving member 43, 44 or 45 and the tool body 34. For the stem 55, fastener 91 engages an internally threaded opening of stem 55. Bushing 92 is positioned within opening 90 and the outer surface of stem 55 registers within the central bore 95 of bushing 92. Bushing 92 is externally threaded at 93 for engaging a correspondingly internally threaded portion of tool body 34 at opening 90. O-rings 60 can be used to interface between stem 55 and bushing 92. A slightly different configuration is provided for attaching stem 54 to tool body 34. Sleeve 94 occupies a position that surrounds stem 54. Sleeve 54 fits inside of bore 95 of bushing 92. The externally threaded portion 93 of bushing 92 engages correspondingly shaped threads of opening 90. Pins 99 form a connection between the stem 54 at openings 98 and the sleeve 94. Fastener 96 forms a connection between bushing 92 and an internally threaded opening 97 of stem 54. As assembled, this configuration can be seen in FIG. 1A for example. The flat surfaces 69, 70 enable fluid to flow in bore 51 in a position radially outwardly or externally of sleeve or sleeve section 52 by passing between the tool body sections 35, 36, 37, 38, 39 and sleeve 52. Thus, bore 51 is divided into two flow channels. These two flow channels 71, 72 include a central flow channel 71 within sleeves 52 that is generally cylindrically shaped and that aligns generally with the channel 53 of each valving member 43, 44, 45. The second flow channel is an annular outer flow channel 72 that is positioned in between a sleeve 52 and the tool body sections 35, 36, 37, 38, 39. The channels 71, 72 can be concentric. The outer channel 72 is open when the valving members 43, 44, 45 are in the closed positions of FIGS. 1A, 1B and 1C, wherein central flow channel 71 is closed.

Figure 4:
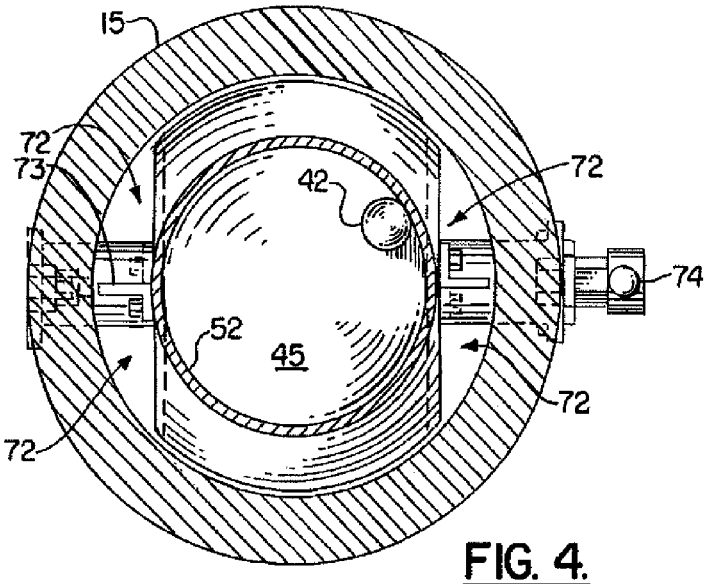
FIG. 4 is a sectional view taken long lines 4-4 of FIG. 2.
Figure 5:
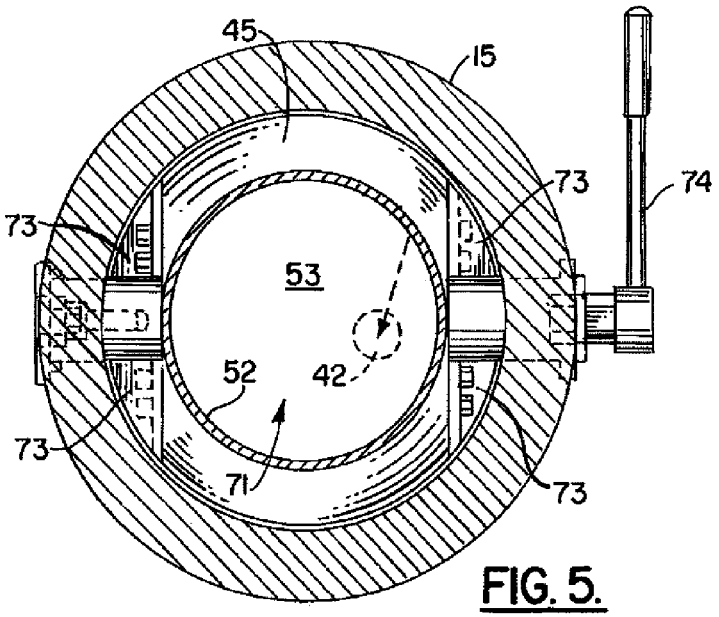
FIG. 5 is a sectional view taken along lines 5-5 of FIG. 3.

When the valving members 43, 44, 45 are rotated to a closed position, fins 73 become transversely positioned with respect to the flow path of fluid flowing in channel 72 thus closing outer flow channel 72 (see FIG. 5). This occurs when a valving member 43, 44, 45 is opened for releasing a ball 40 or 42 or for releasing dart 41. FIG. 4 illustrates a closed position (FIG. 4) of the valving member 45 just before releasing smaller diameter ball 42. Fins 73 are generally aligned with bore 15 and with flow channels 71, 72 when flow in channel 72 is desired (FIG. 4). In FIG. 4, valving member 45 is closed and outer flow channel 72 is open.

Figure 7:
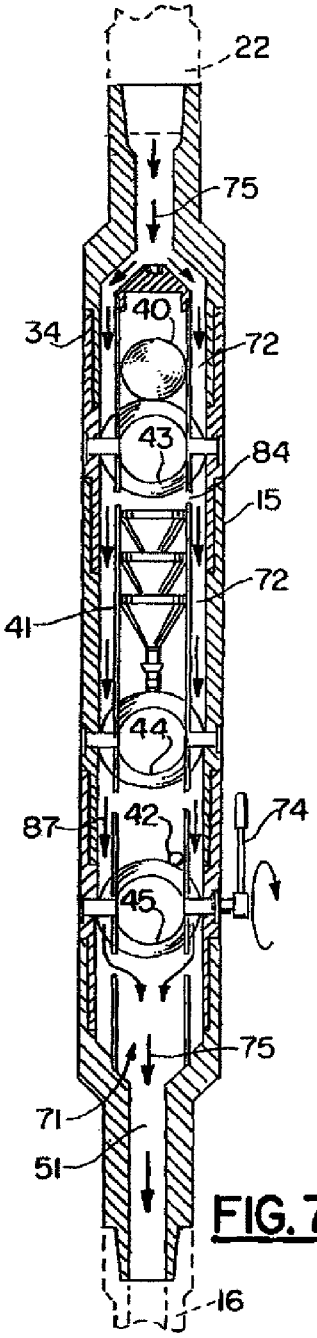
FIG. 7 is a sectional, elevation view of a preferred embodiment of the apparatus of the present invention and illustrating a method step of the present invention.
Figure 8:
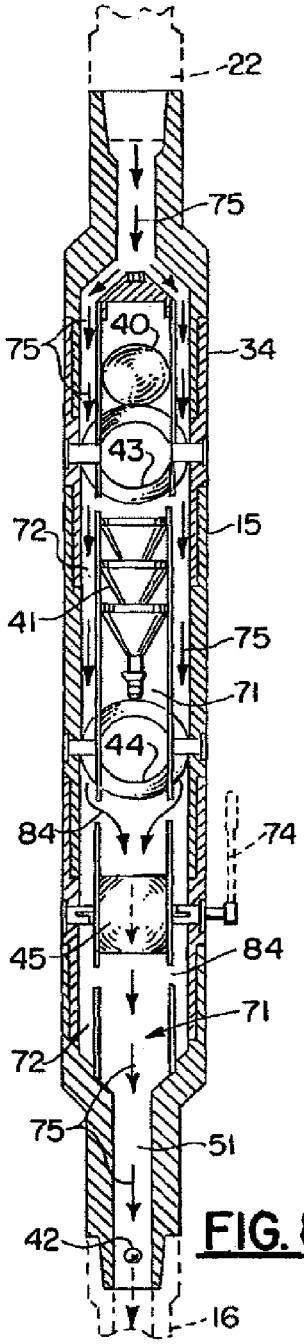
FIG. 8 is a sectional, elevation view of a preferred embodiment of the apparatus of the present invention and illustrating a method step of the present invention.

In FIGS. 2-3, 5 and 7-8, a tool 74 has been used to rotate valving member 45 to an open position that aligns its channel 53 with central flow channel 71 enabling smaller diameter ball 42 to fall downwardly via central flow channel 71 (FIG. 8). In FIG. 5, outer flow channel 72 has been closed by fins 73 that have now rotated about 90 degrees from the open position of FIG. 4 to the closed position. Fins 73 close channel 72 in FIG. 5. It should be understood that tool 74 can also be used to rotate valving member 44 from an open position of FIG. 1B to a closed position such as is shown in FIG. 5 when it is desired that dart 41 should drop. Similarly, tool 74 can be used to rotate upper valving member 43 from the closed position of FIG. 1A to an open position such as is shown in FIG. 5 when it is desired to drop larger diameter ball 40.

FIGS. 7-16 illustrate further the method and apparatus of the present invention. In FIG. 8, lower or third valving member 45 has been opened as shown in FIG. 5 releasing smaller diameter ball 42. In FIG. 8, smaller diameter ball 42 is shown dropping wherein it is in phantom lines, its path indicated schematically by arrows 75.

FIG. 10 shows a pair of commercially available, known plugs 76, 77. These plugs 76, 77 include upper plug 76 and lower plug 77. Each of the plugs 76, 77 can be provided with a flow passage 79, 81 respectively that enables fluid to circulate through it before ball 42 forms a seal upon the flow passage 81. Smaller diameter ball 42 has seated upon the lower plug 77 in FIG. 10 so that it can now be pumped downwardly, pushing cement 80 ahead of it. In FIG. 11, arrows 78 schematically illustrate the downward movement of lower plug 77 when urged downwardly by a pumped substance such as a pumpable cement or like material 80. Each of the plugs 76, 77 can be provided with a flow passage 79, 81 respectively that enables fluid to circulate through it before ball 42 forms a seal upon the flow passage 81 (see FIG. 11). When plug 77 reaches float valve 28, pressure can be increased to push ball 42 through plug 77, float valve 28 and casing shoe 27 so that the cement flows (see arrows 100, FIG. 11) into the space 101 between formation 26 and casing 32.

Figure 12:
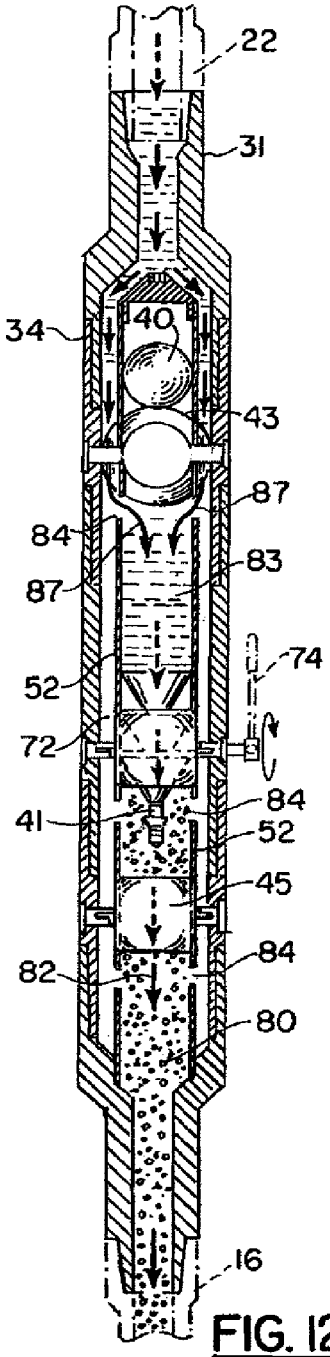
FIG. 12 is a sectional, elevation view illustrating part of the method of the present invention.
Figure 13:
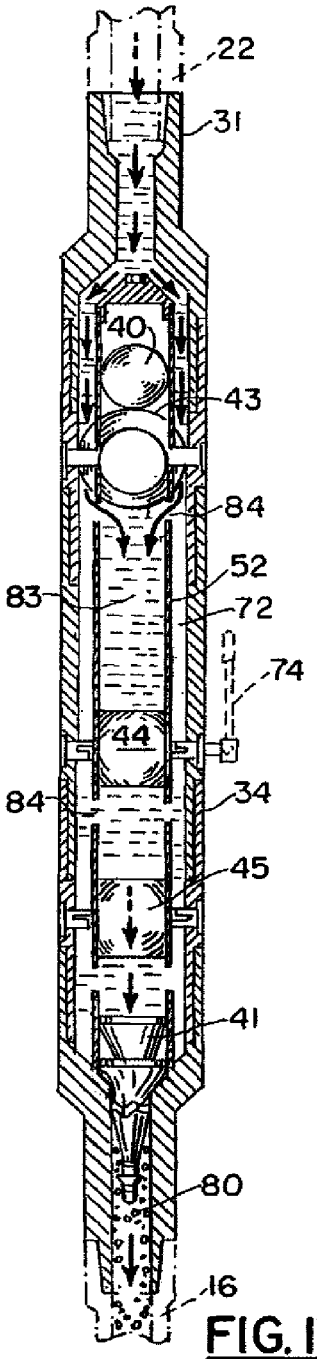
FIG. 13 is a sectional, elevation view illustrating part of the method of the present invention.

In FIG. 12, second valving member 44 is opened releasing dart 41. Dart 41 can be used to push the cement 80 downwardly in the direction of arrows 82. A completion fluid or other fluid 83 can be used to pump dart 41 downwardly, pushing cement 80 ahead of it. Once valves 44 and 45 are opened, fluid 83 can flow through openings 84 provided in sleeves 52 below the opened valving member (see FIG. 7) as illustrated in FIGS. 7 and 12. Thus, as each valving member 43 or 44 or 45 is opened, fluid moves through the openings 84 into central flow channel 71.

Figure 14:
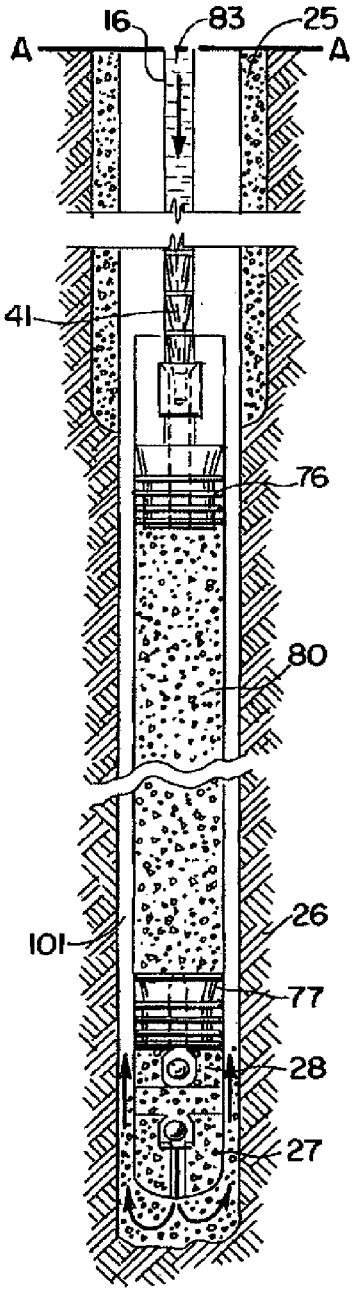
FIG. 14 is a sectional, elevation view illustrating part of the method of the present invention and wherein line A-A of FIG. 14 matches line A-A of FIG. 9.
Figure 15:
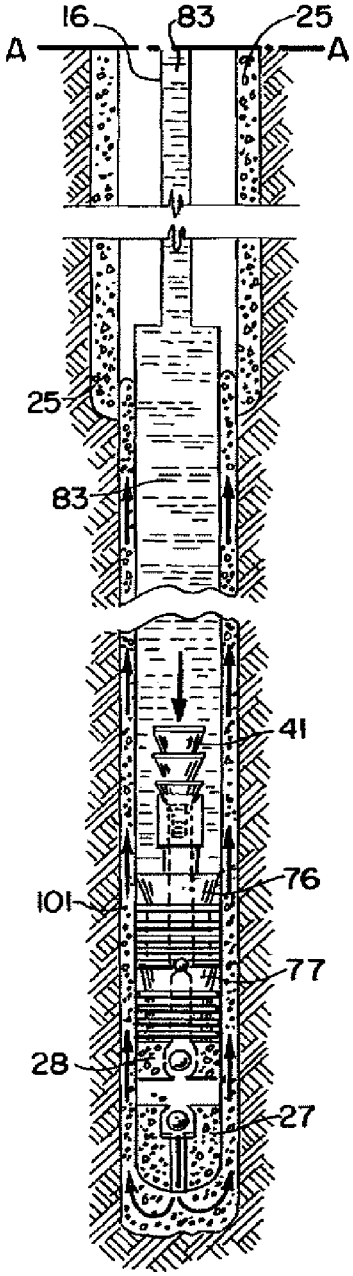
FIG. 15 is a sectional, elevation view illustrating part of the method of the present invention and wherein line A-A of FIG. 15 matches line A-A of FIG. 9.
Figure 16:
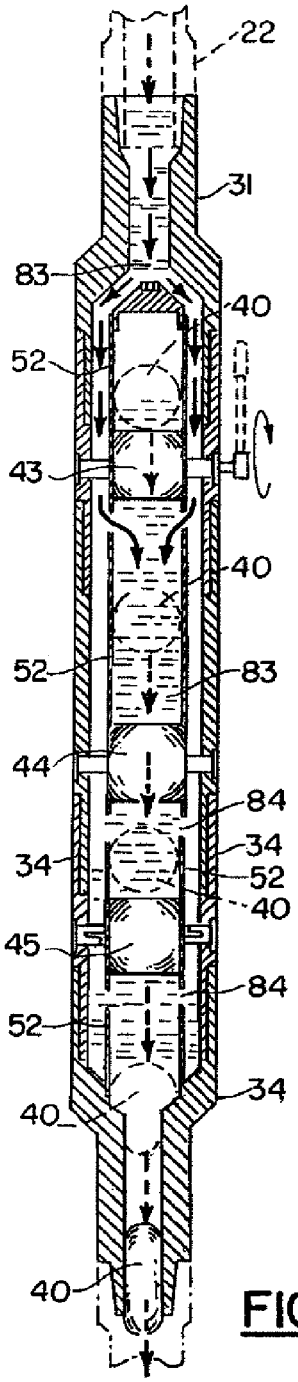
FIG. 16 is a sectional, elevation view illustrating part of the method of the present invention.

When valve 44 is opened, dart 41 can be pumped downwardly to engage upper plug 76, registering upon it and closing its flow passage 79, pushing it downwardly as illustrated in FIGS. 14 and 15. Upper plug 79 and dart 41 are pumped downwardly using fluid 83 as illustrated in FIGS. 14 and 15. In FIG. 16, first valving member 43 is opened so that larger diameter ball 40 can move downwardly, pushing any remaining cement 80 downwardly.

The ball 40 can be deformable, so that it can enter the smaller diameter section 86 at the lower end portion of tool body 34. During this process, cement or like mixture 80 is forced downwardly through float collar 28 and casing shoe 27 into the space that is in between production casing 32 and formation 26. This operation helps stabilize production casing 32 and prevents erosion of the surrounding formation 26 during drilling operations.

During drilling operations, a drill bit is lowered on a drill string using derrick 12, wherein the drill bit simply drills through the production casing 32 as it expands the well downwardly in search of oil.

Figure 20:
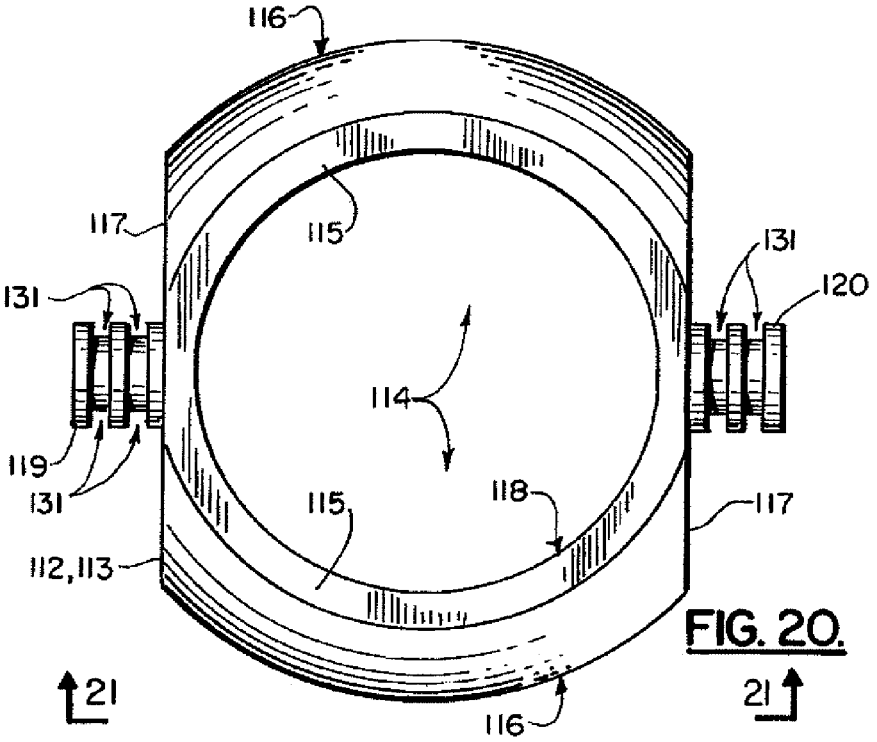
FIG. 20 is a partial view of a second embodiment of the apparatus of the present invention and showing a ball valving member.
Figure 21:
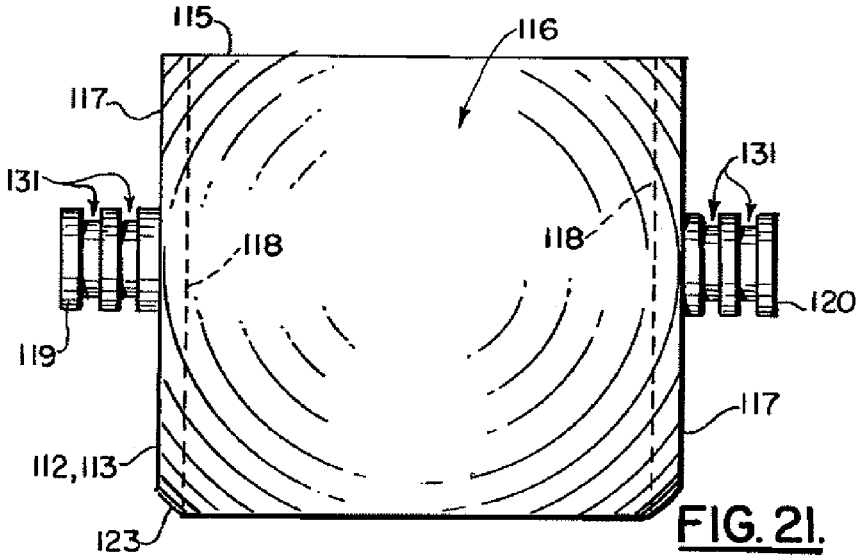
FIG. 21 is a partial side view of a second embodiment of the apparatus of the present invention and showing an alternate construction for the ball valving member.
Figure 22:
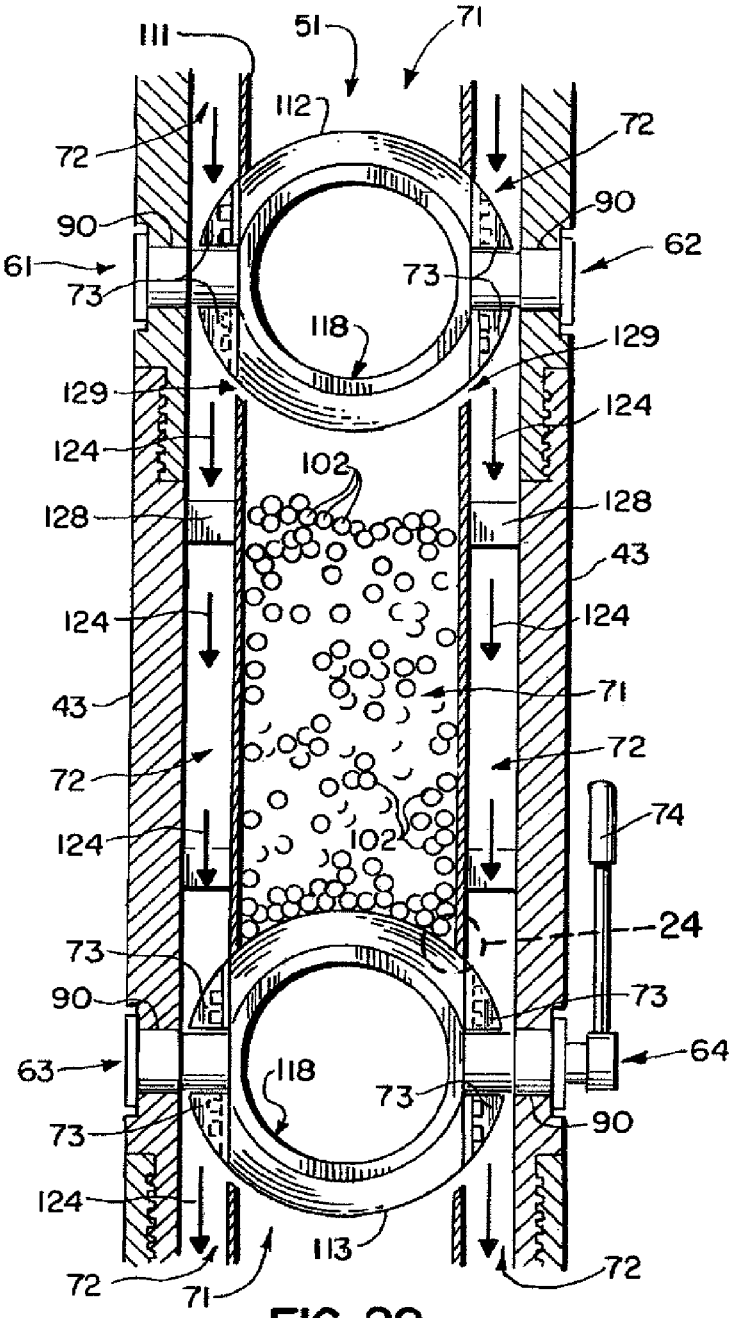
FIG. 22 is a sectional view of a second embodiment of the apparatus of the present invention showing an alternate sleeve arrangement.
Figure 23:
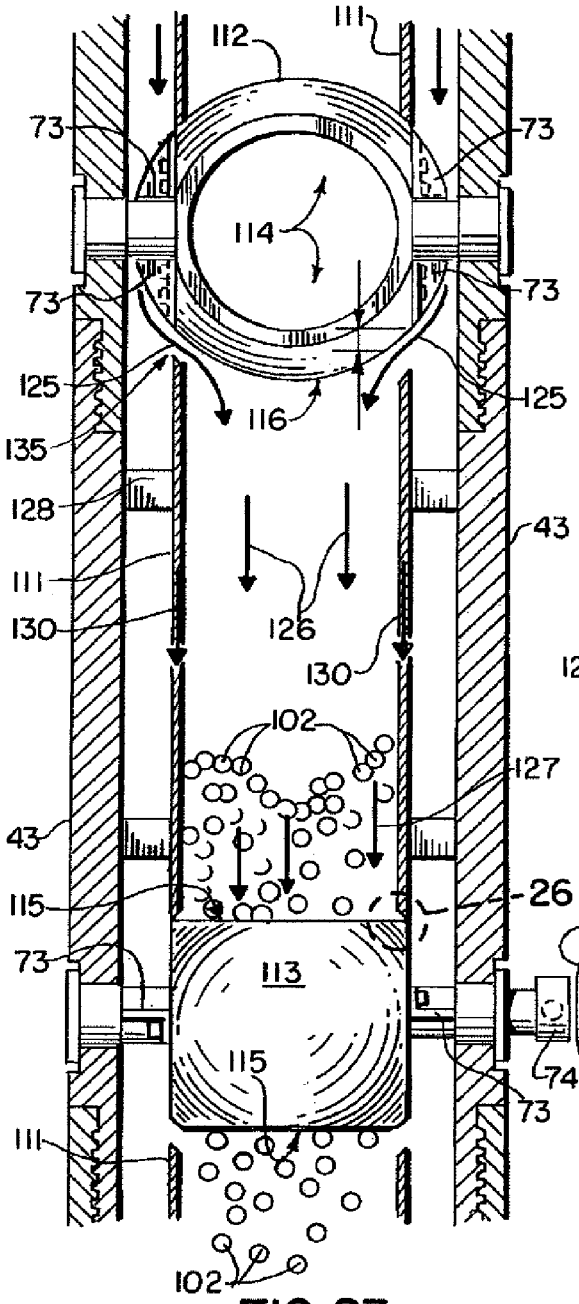
FIG. 23 is a sectional view of a second embodiment of the apparatus of the present invention showing an alternate sleeve arrangement.
Figure 24:
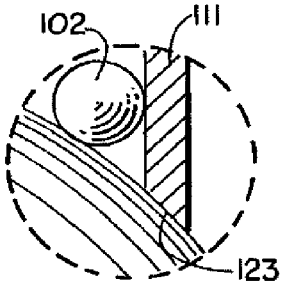
FIG. 24 is a fragmentary view of a second embodiment of the apparatus of the present invention.
Figure 25:
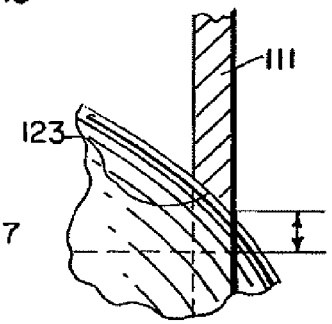
FIG. 25 is a fragmentary view of a second embodiment of the apparatus of the present invention.
Figure 26:
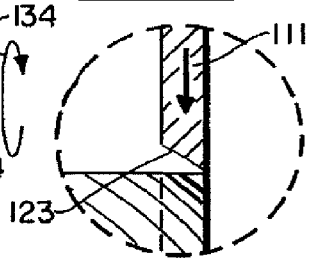
FIG. 26 is a fragmentary view of a second embodiment of the apparatus of the present invention.

FIGS. 18-26 show an alternate embodiment of the apparatus of the present invention, designated generally by the numeral 110 in FIGS. 22-23. In FIGS. 18-26, the flow openings 84 in sleeves 52 of ball/plug dropping head 110 of FIGS. 1-17 have been eliminated. Instead, sliding sleeves 111 are provided that move up or down responsive to movement of a selected valving member 112, 113. It should be understood that the same tool body 34 can be used with the embodiment of FIGS. 18-26, connected in the same manner shown in FIGS. 1-17 to tubular member 22 and string 16. In FIGS. 18-26, valving members 112, 113 replace the valving members 43, 44, 45 of FIGS. 1-17. In FIGS. 18-26, sleeves 111 replace sleeves 52. While two valving members 112, 113 are shown in FIGS. 22, 23, it should be understood that three such valving members (and a corresponding sleeve 111) could be employed, each valving member 112, 113 replacing a valving member 43, 44, 45 of FIGS. 1-17.

Figure 19:
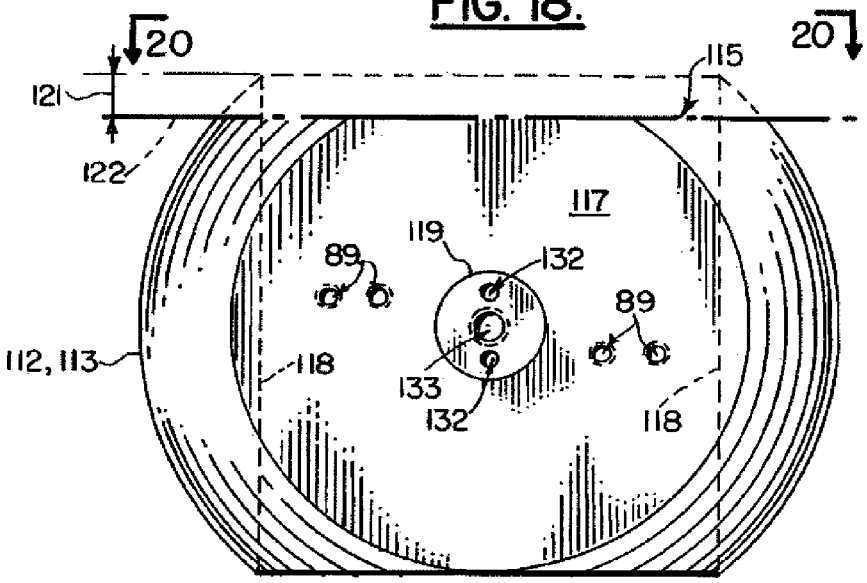
FIG. 19 is a partial side view of a second embodiment of the apparatus of the present invention and showing an alternate construction for the ball valving member.

In FIGS. 18-26, tool body 34 has upper and lower end portions 31, 33. As with a preferred embodiment of FIGS. 1-17, a flow bore 51 provides a central flow channel 71 and outer flow channel 72. Each valving member 112, 113 provides a valve opening 114. Each valving member 112, 113 provides a flat surface 115 (see FIG. 20). Each valving member 112, 113 provides a pair of opposed curved surfaces 116 as shown in FIG. 20 and a pair of opposed flat surfaces 117, each having a stem 119 or 120.

An internal, generally cylindrically shaped surface 118 surrounds valve opening 114 as shown in FIG. 20. Each valving member 112, 113 provides opposed stems 119, 120. Each valving member 112, 113 rotates between opened and closed positions by rotating upon stems 119, 120. Each of the stems 119, 120 is mounted in a stem opening 90 of tool body 34 at positions 61, 62 and 63, 64 as shown in FIG. 22.

In FIG. 19, valving member 122, 123 is similar in configuration and in sizing to the valving members 43, 44, 45 of a preferred embodiment of FIGS. 1-17, with the exception of a portion that has been removed which is indicated in phantom lines in FIG. 19. The milled or cut-away portion of the valving member 112, 113 is indicated schematically by the arrow 121. Reference line 122 in FIG. 19 indicates the final shape of valving member 112, 113 after having been milled or cut. In FIGS. 20 and 21, a beveled edge at 123 is provided for each valving member 112, 113.

When a valving member 112, 113 is in the closed position of FIG. 22, flow arrows 124 indicate the flow of fluid through the tool body 34 bore 51 and more particularly in the outer channel 72 as indicated in FIG. 22.

In FIG. 23, the lower valving member 113 has been rotated to an open position as indicated schematically by the arrow 134, having been rotated with tool 74. In this position, fins 73 now block the flow of fluid in outer channel 72. Flat surface 115 now faces upwardly. In this position, the cut-away portion of valving member 113 that is indicated schematically by the arrow 121 in FIG. 19 now faces up. Sliding sleeve 111 drops downwardly as indicated schematically by arrows 130 when a valving member 112 or 113 is rotated to an open position (see valving member 113 in FIG. 23). In FIG. 22, a gap 129 was present in between upper valve 112 and sleeve 111 that is below the valve 112. The sleeve 111 that is in between the valves 112, 113 is shown in FIG. 22 as being filled with very small diameter balls or "frac-balls" 102.

When valving member 113 is rotated to the open position of FIG. 23, the gap is now a larger gap, indicated as 135. Gap 135 (when compared to smaller gap 129) has become enlarged an amount equal to the distance 121 illustrated by arrow 121 in FIG. 19. The frac-balls 102 now drop through valving member 113 as illustrated by arrows 127 in FIG. 23. Arrows 125, 126 in FIG. 23 illustrate the flow of fluid downwardly through gap 135 and in central channel 71.

A sleeve 111 above a valving member 112 or 113 thus move up and down responsive to a rotation of that valving member 112 or 113. Spacers 28 can be employed that extend from each sleeve 111 radially to slidably engage tool body 34. In FIGS. 20 and 21, each stem 119, 120 can be provided with one or more annular grooves 131 that are receptive of o-rings 60 or other sealing material. As with a preferred embodiment of FIGS. 1-17, openings 132 in each stem 119, 120 are receptive of pins 99. Likewise, each stem 119, 120 provides internally threaded openings 133. Thus, the same connection for attaching a valving member 112, 113 to tool body 34 can be the one shown in FIGS. 1-17.

FIGS. 27A-33 show another embodiment of the apparatus of the present invention wherein the tool body 136 provides an upper sleeve 140 that differs in construction from the sleeve of the embodiments of FIGS. 1-26. Further, the tool body 136 of FIGS. 27A-33 provides an indicator 147 that indicates to a user whether or not a ball or dart 145, 146 has in fact been discharged from the tool body 136. Further, the embodiment of FIGS. 27A-33 provides specially configured inserts or sleeves 160, 163 that are positioned below the lower valve 113, this additional sleeve or insert 160 is configured to prevent a build-up of material within the flow bore 51 below lower valving member 113.

In FIGS. 27A-33, tool body 136 provides upper end portion 137 and lower end portion 138. As with the embodiments of FIGS. 1-26, the tool body 136 can be formed similarly to the tool body 34, having multiple sections 35, 36, 37, 38 and 139. The section 139 is similar to the section 39 of FIGS. 1-26. However, the section 139 is configured to accept sleeve or insert 160 and sleeve or insert 163.

Sleeve 140 is similar to the sleeves 111 of FIGS. 18-26. The sleeve 140 provides a cap 141 that can be connected to the sleeve 140 using threaded connection 142. Cap 141 provides one or more longitudinally extending and circumferentially spaced apart openings 143. The cap 141 can also provide a tool receptive socket 144 that enables rotation of cap 141, relative to sleeve 140, using a tool (e.g. allen wrench) during assembly of cap 141 to sleeve 140.

In FIGS. 27B, 28-33 indicator 147 is shown. The indicator 147 indicates to a user whether or not a dart 145, 146 has passed the indicator 147, thus indicating a discharge of the dart 145, 146 from the tool body 136.

Figure 27A:
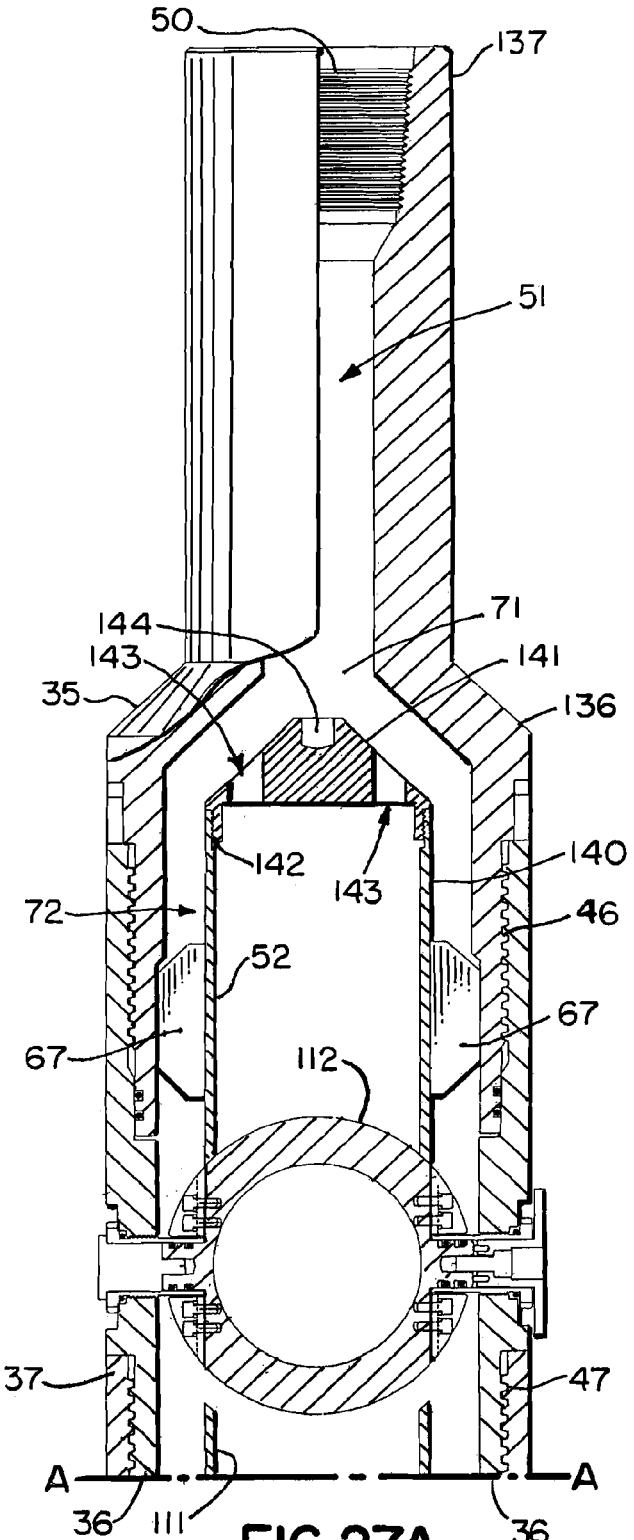
FIGS. 27A, 27B, 27C are sectional, elevation views of a third embodiment of the apparatus of the present invention wherein the lines A-A are match lines and the lines B-B are match lines.
Figure 27B:
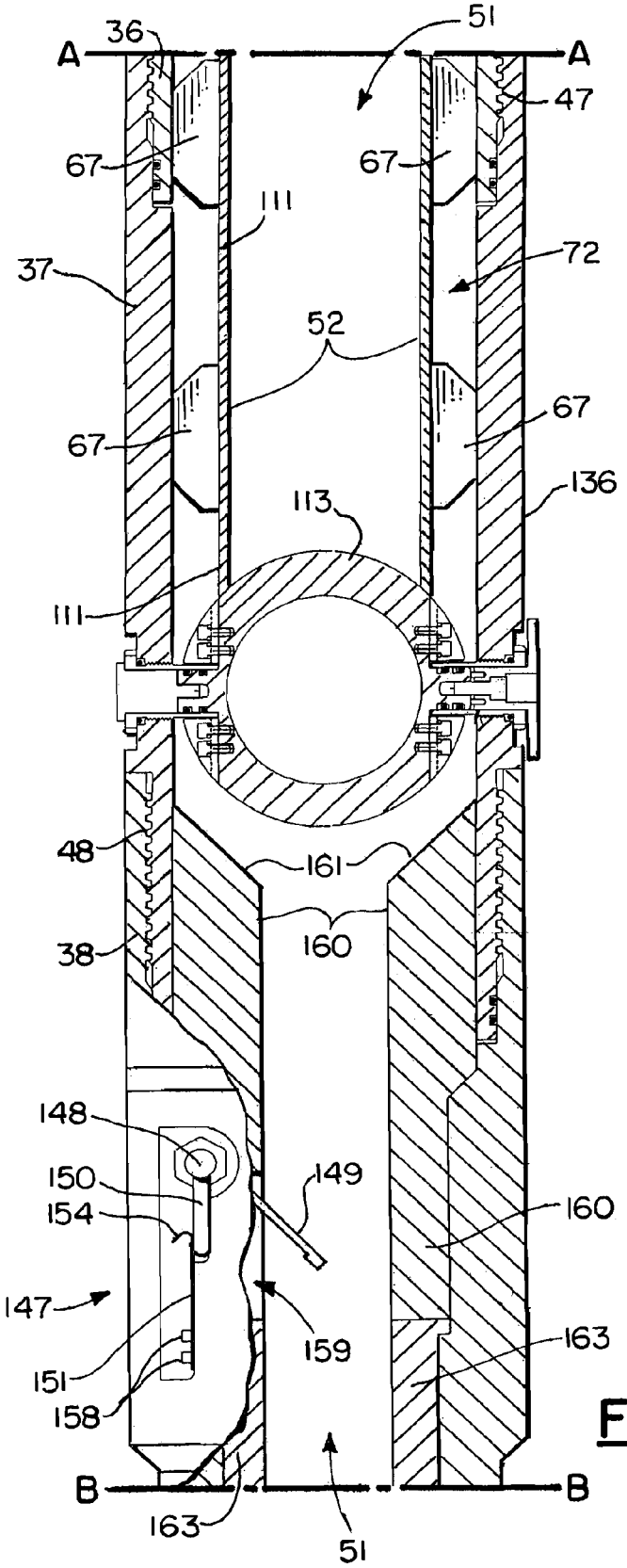
Figure 28:
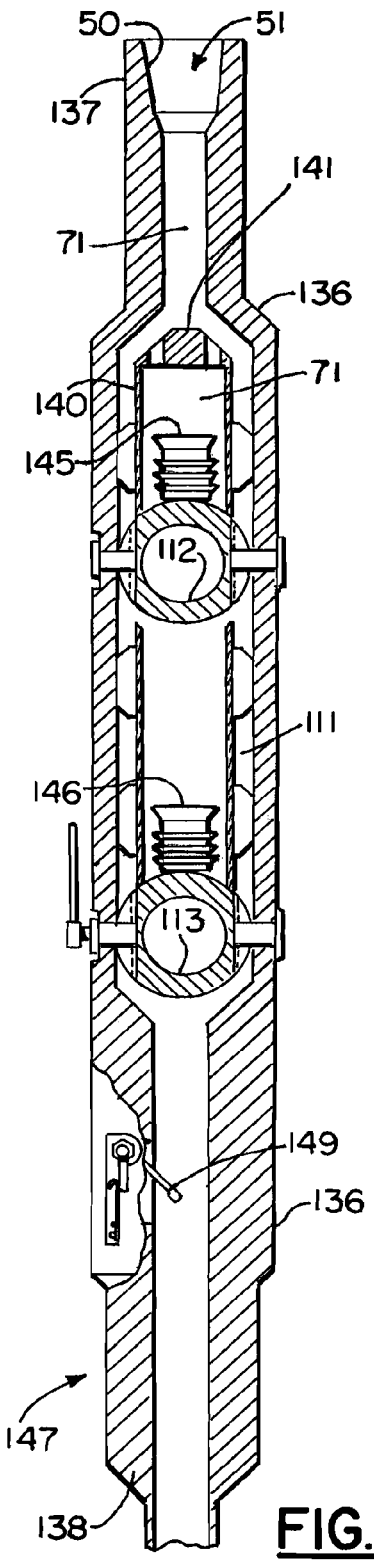
FIG. 28 is a sectional, elevation view of a third embodiment of the apparatus of the present invention showing both valves in a closed position.
Figure 29:
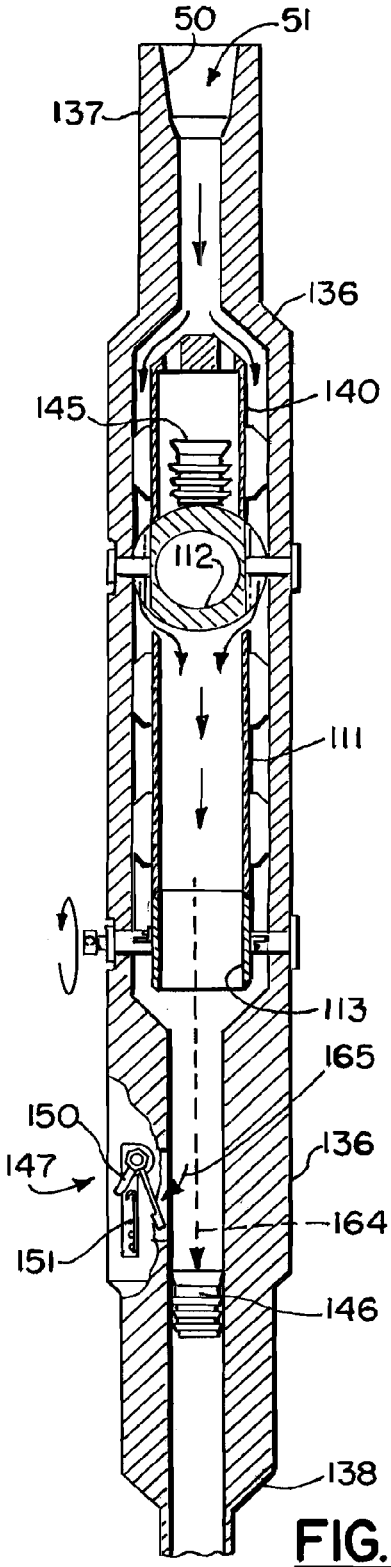
FIG. 29 is a sectional, elevation view of a third embodiment of the apparatus of the present invention showing the upper valve in a closed position and the lower valve in an open position.

In FIGS. 27B and 28-33, indicator 147 provides a shaft 148 that extends horizontally relative to flow bore 51 of tool body 136. Lever arm 149 moves between an extended position as shown in FIG. 27B and a collapsed position as shown in FIG. 29. The lever arm 149 is initially set in the extended position of FIG. 27B by placing pin 150 behind spring 151 upper end 154 as shown in FIG. 27B. Spring 151 thus holds the pin 150 in a generally vertical position by rotating shaft 148 so that arm 149 extends into flow bore 51.

In FIG. 28, upper valve 112 is shown supporting a first dart 145. Lower valve 113 is shown supporting a second dart 146. Operation is the same as was described with respect to FIGS. 1-26. Lower valve 113, is rotated to an open position as shown in FIG. 29 by rotating the valve 113 through about ninety degrees. Dart 146 then drops as indicated by arrow 164 in FIG. 29. As the dart 146 travels downwardly, leaving valve 113 and moving toward lower end portion 138 of tool body 136, the dart 146 engages lever arm 149. The dart 146 continues to move downwardly, pushing the arm 149 to the retracted position of FIG. 29 as illustrated by arrow 165 in FIG. 29. In this position, the pin 150 deflects spring 151 until pin 150 assumes the position shown in phantom lines in FIG. 32.

Figure 30:
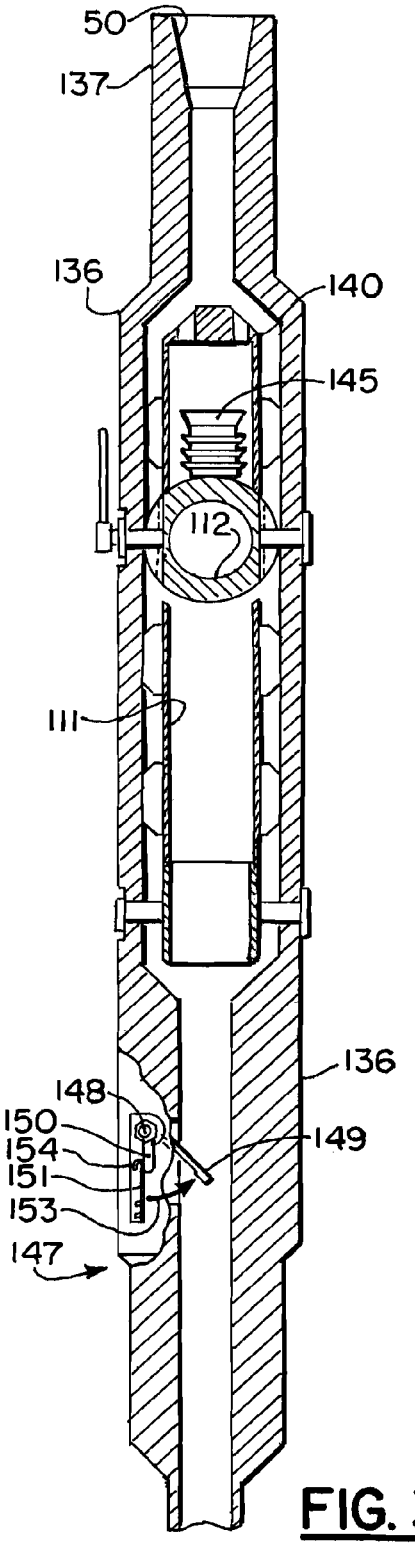
FIG. 30 is a sectional, elevation view of a third embodiment of the apparatus of the present invention.
Figure 31:
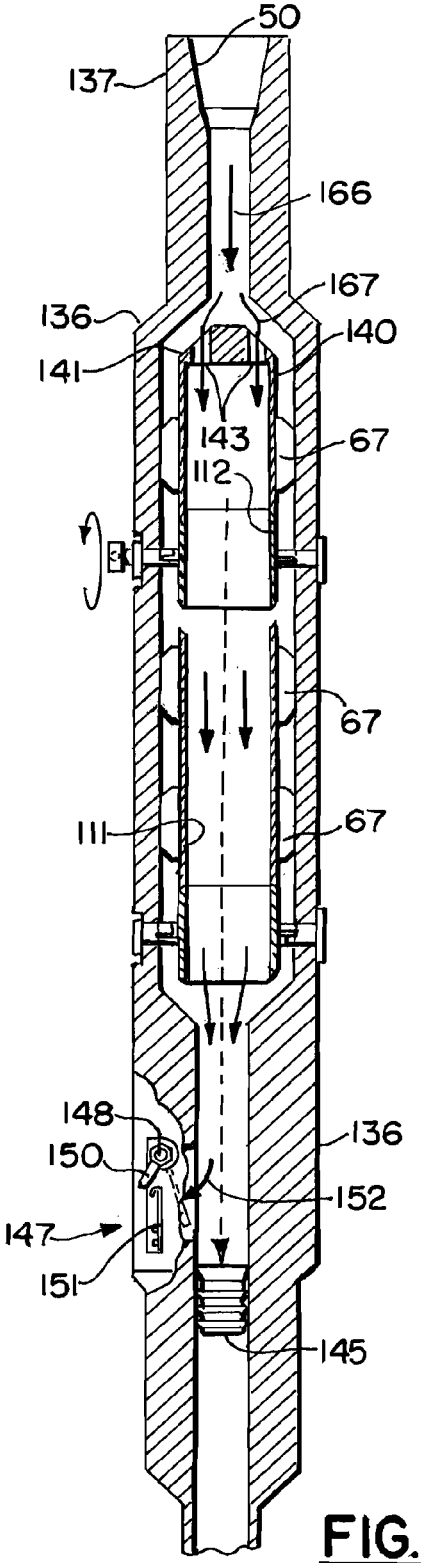
FIG. 31 is a sectional, elevation view of a third embodiment of the apparatus of the present invention showing both valves in an open position.
Figure 32:
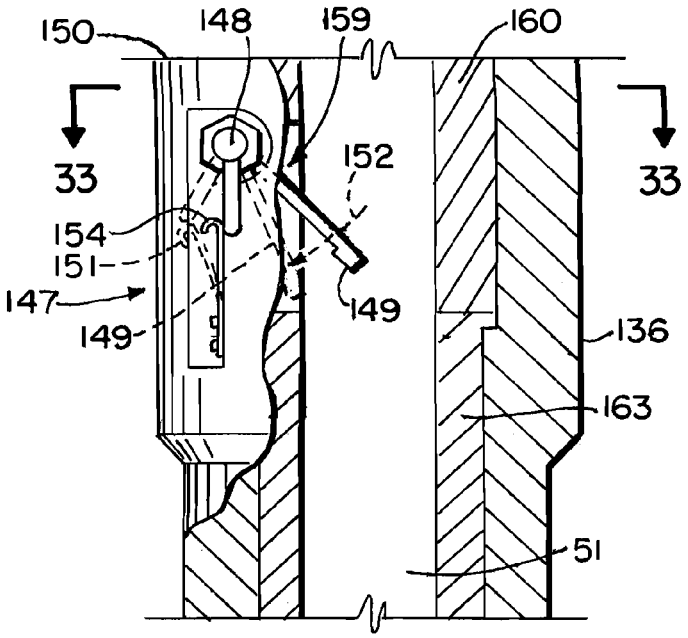
FIG. 32 is a fragmentary, sectional, elevation view of a third embodiment of the apparatus of the present invention.

The spring 151 upper end portion 154 prevents the pin 150 from returning to the position of FIG. 28, as the pin is now being held in the position shown in FIG. 29. Arrow 152 in FIG. 32 illustrates the travel of arm 149 from the extended position to the retracted position. An operator can then reset the indicator 147 by rotating the pin 150 to the position shown in FIG. 30 as illustrated by arrow 153 in FIG. 30. This procedure can then be repeated for the upper and second dart 145 as illustrated in FIGS. 30 and 31. In FIG. 31, the upper valve 112 is moved to an open position. A working fluid is pumped into tool body 136 at upper end 137. Flow moves downwardly in the tool body 136 as illustrated by arrows 166. Flow travels through openings 143 in cap 141 as illustrated by arrows 167 in FIG. 31. This downward flow moves the darts 145, 146 downwardly.

Figure 33:
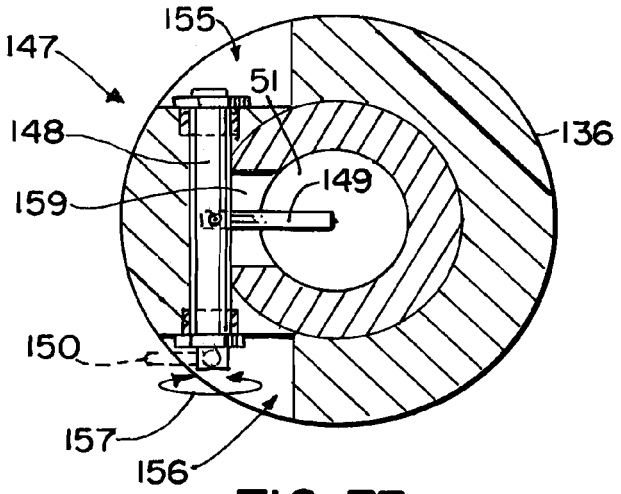
FIG. 33 is a sectional view taken along lines 33-33 of FIG. 32.
Figure 34A:
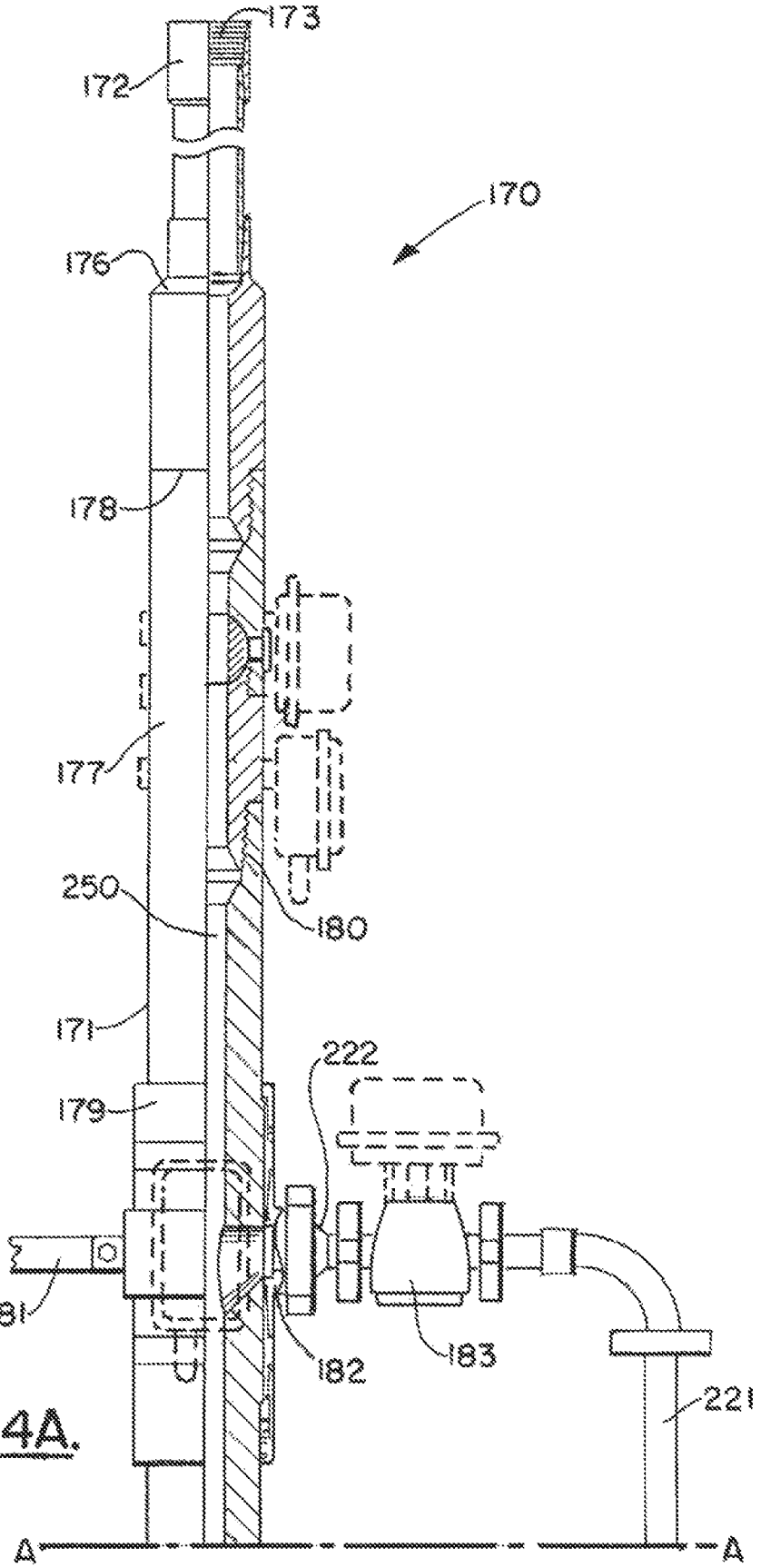
FIGS. 34A, 34B, 34C are schematic sectional views of a fourth embodiment of the apparatus of the present invention.
Figure 34B:
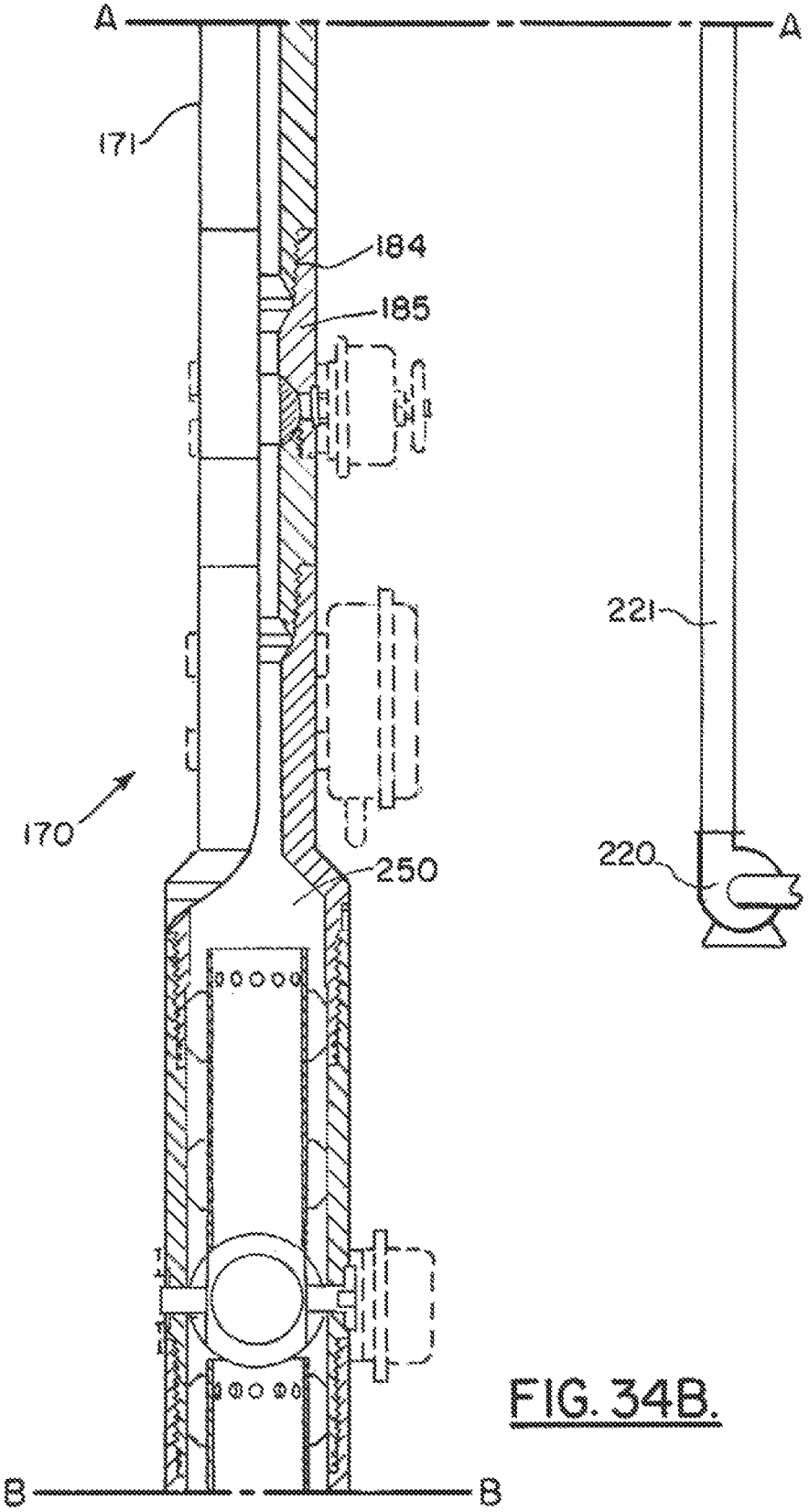
Figure 34C:
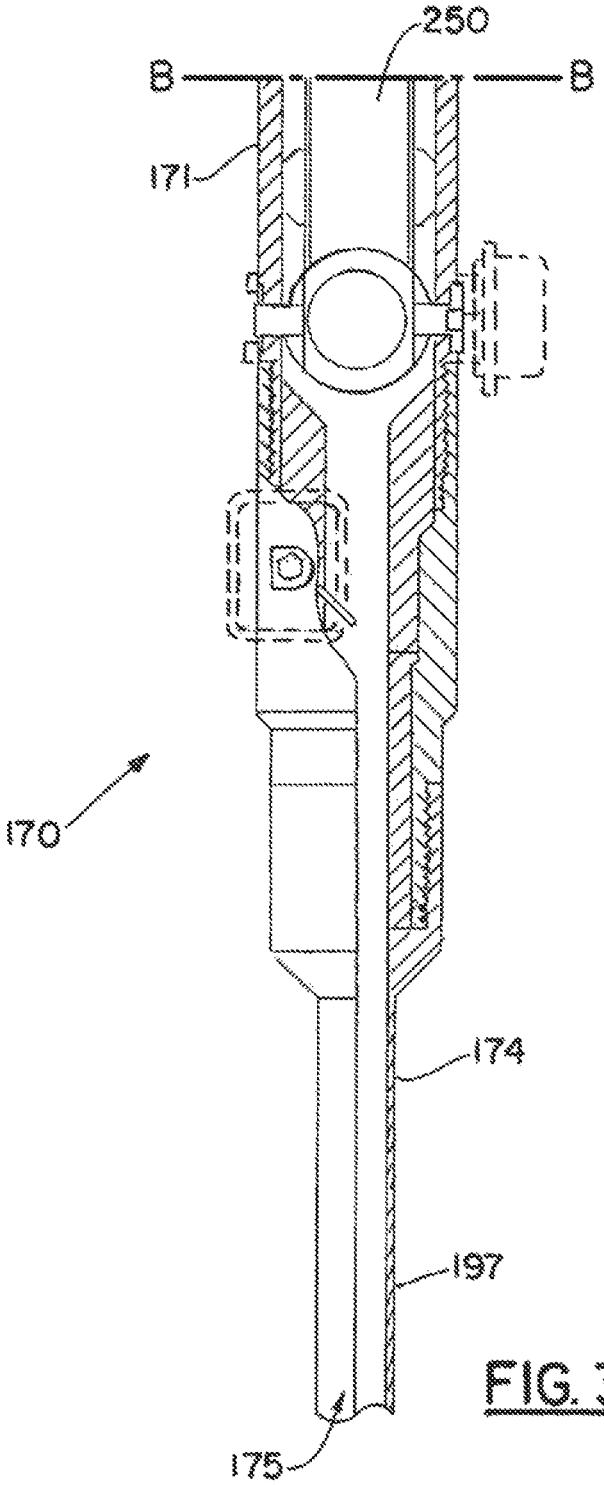
Figure 35:
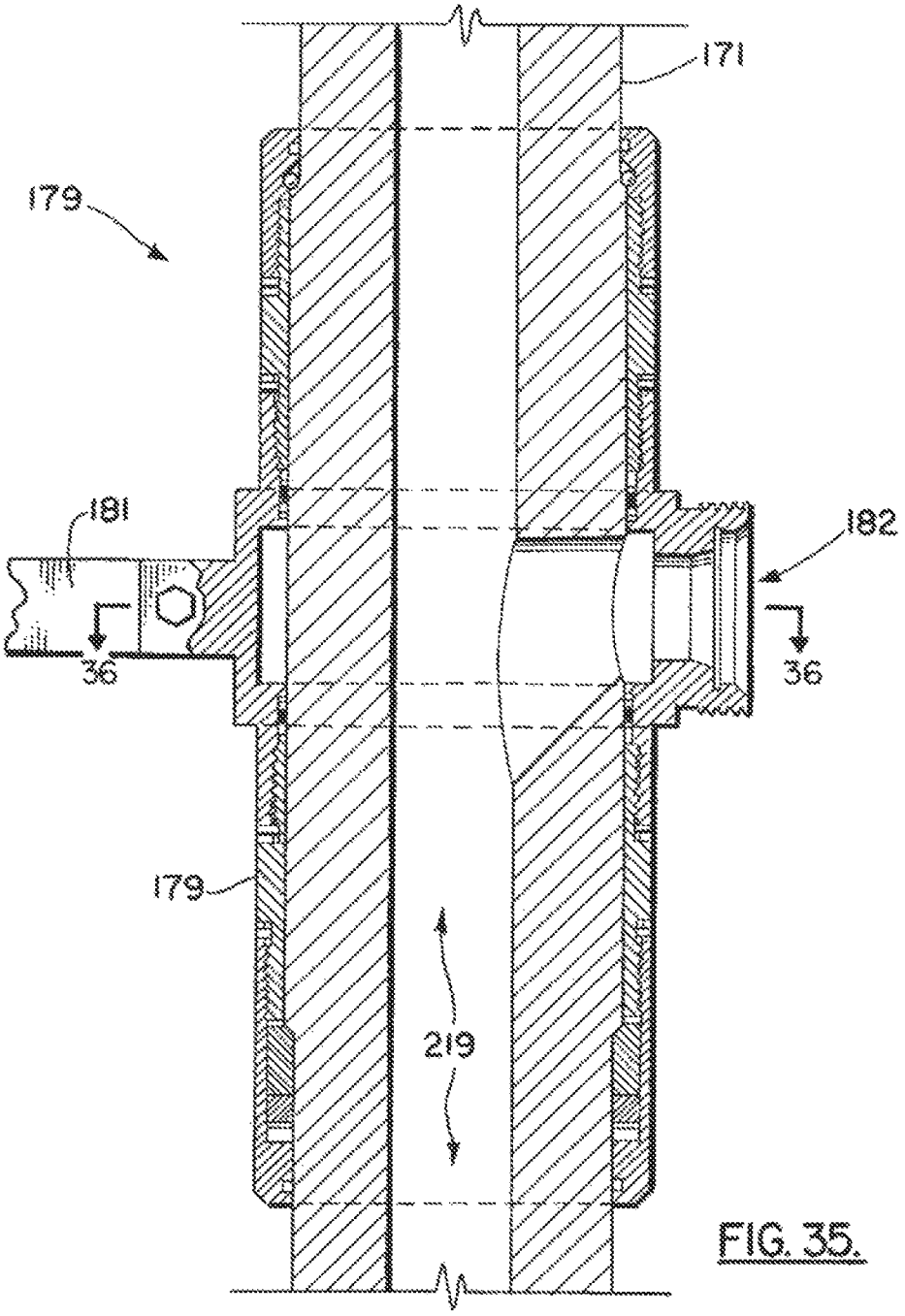
FIG. 35 is a partial sectional fragmentary view of a fourth embodiment of the apparatus of the present invention, showing the transmitter module.
Figure 36:
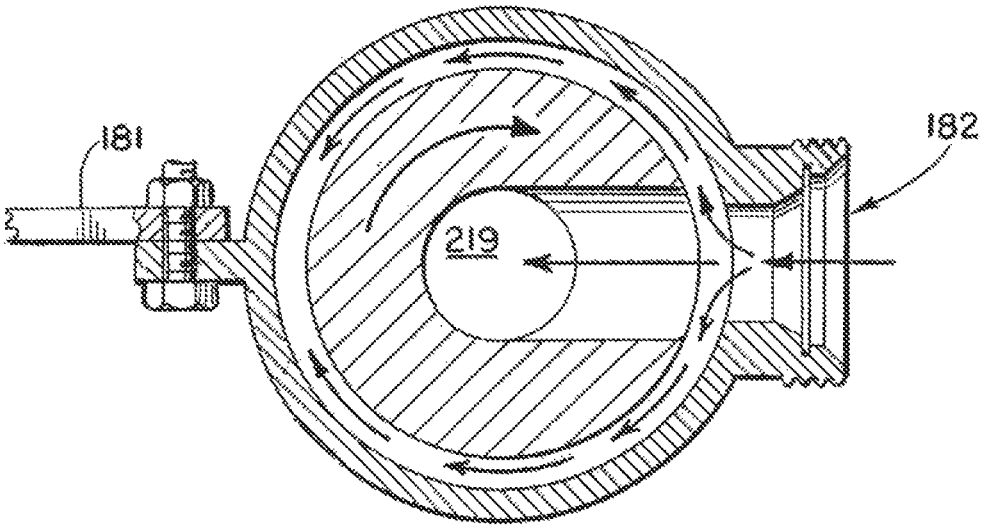
FIG. 36 is a sectional view taken along lines 36-36 of FIG. 35.

Indicator 147 can be attached to tool body 136 as shown in FIG. 33. A pair of recesses 155, 156 on tool body 136 enable attachment of shaft 148. The shaft 148 can be held in position using fasteners such as bolts, for example. Spring 151 can then be attached to tool body 136 at recess 156 using fasteners 158 such as bolts. Curved arrow 157 in FIG. 33 illustrates rotation of shaft 148 for moving arm 149 and pin 150 between the extended position of FIG. 30 and the retracted position of FIG. 31. Arm 149 extends through slot 159 in the extended position of FIGS. 30, 32, 33.

Figure 27C:
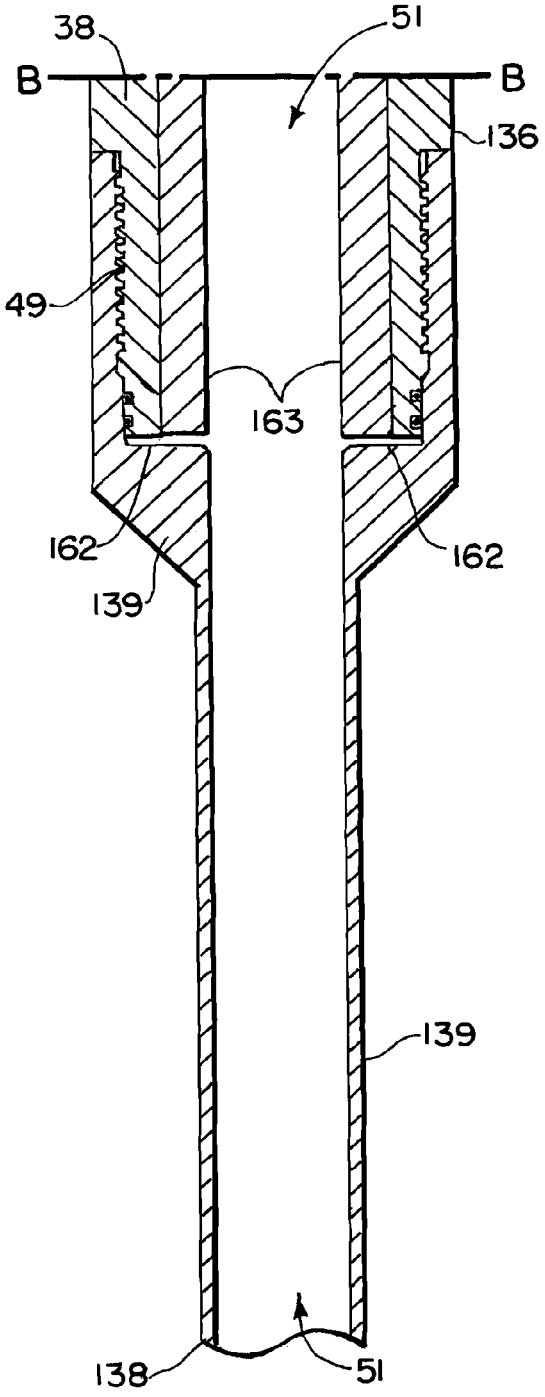

FIGS. 27C and 32 illustrate placement of insert/sleeves 160, 163. The sleeve 160 provides an upper end portion that is conically shaped or tapered. This tapered section 161 is placed just below lower valve 113 and aids in the efficient flow of fluid downwardly in the tool body 136 eliminating unnecessary accumulation of material such as cement. Annular shoulder 162 on tool body 136 enables support of lower insert 163 which is placed below upper insert 160 as shown in FIGS. 27B and 27C.

FIGS. 34A-63 show a fourth embodiment of the apparatus of the present invention, designated generally by the numeral 170 in FIGS. 34A, 34B, 34C and 39. In FIGS. 34-63, wireless transmissions are used to open and close valving members. In FIGS. 34A-C and 39, a tool body 171 can include any of the configurations of the embodiments of FIGS. 1-33. The tool body assembly 171 can also include a kelly valve or valves or other well control safety valve(s) which are also remotely operated using a wireless signal. Kelly valves are known and commercially available from M & M International (www.mmvalves.com) and others. Many kelly valve designs have been patented. Examples of kelly valves are seen in U.S. Pat. Nos. 3,941,348; 4,262,693; 4,303,100; 4,625,755; 5,246,203; and 6,640,824 each of which is incorporated herein by reference. A transmitter 210 (see FIGS. 37-38) is used to transmit a wireless signal to a primary receiver 198, which then transmits signals to secondary receivers 199, 200 in FIG. 39. The wireless transmission from transmitter 210 can employ a frequency hopping spread spectrum method.

In FIGS. 34A-C and 39, tool body 171 has upper end portion 172 with connector 173 and lower end portion 174 with connector 175. Connectors 173, 175 can be threaded connectors. The tool body 171 can be sized and/or configured for use with drill pipe or casing. An upper crossover tool 176 can be used to connect the tool body 171 to a top drive. Similarly, a lower crossover tool 197 can be used to connect with a string of drill pipe or casing. Upper crossover tool 176 connects to kelly valve 177 at threaded connection 178. Swivel 179 (e.g., a torque through swivel—see FIGS. 34A and 35) connects to the upper kelly valve 177 at a connection 180 (e.g., threaded connection). Alternatively, a sub 188 can be placed between kelly valve 177 and swivel 179. Swivel 179 connects to a lower kelly valve 185 at a connection 184 which can be a threaded connection. A sub 188 can be placed in between swivel 179 and kelly valve 185.

Swivel 179 is commercially available and provides rotating and non-rotation or non-rotating portions. Torque arm 181 holds the non-rotation or non-rotating part of the swivel 179 to prevent rotation while the portions of tool body 171 above connection 180 and below connection 184 rotate.

Inlet 182 enables the intake of fluid such as a cementitious mix to swivel 179 such as for cementing operations down hole in the oil well. Swivel 179 has a bore 219 that enables communication with the bore 250 of tool body assembly 171 as seen in FIGS. 1-33, 34A-C, 35, 39 and 55-57. A cement pump 220 pumps the cement via flow line or hose 221 to a valve 183 such as low torque valve 183. Inlet 182 can be fitted with reducer 222 and low torque valve 183 which can be opened or closed to allow inflow of the selected cementitious mix (see FIGS. 34A, 34B and 39).

Sub or top sub 188 is fitted between kelly valve 185 and the cementing head 187. A threaded or other connection at 186 connects sub 188 to kelly valve 185. A threaded or other connection at 189 joins sub 188 to cementing head 187. Cementing head 187 can be any of the plug dropping apparatus shown and described herein. In FIGS. 34A-34C and 39, plug dropping head 187 employs two (2) plug chambers 190, 192. The plug chamber 190 is a top plug chamber. The plug chamber 192 is a bottom plug chamber. A connection 191 (e.g. threaded) joins chambers 190, 192.

Connection 193 (e.g. threaded) joins lower plug chamber 192 to sub 194. Sub 194 can be a sub with indicator 194. Sub 196 connects to crossover 197 with a connection such as a threaded connection 195. A crossover 197 can be a bottom crossover to casing (or pipe).

In FIGS. 34A-C and 39, a primary receiver 198 receives a transmission from transmitter module 210. The transmitter 210 is equipped with a number of toggle switches 218, each switch operating a selected electrical actuator 201-206. These actuators 201-206 enable any valve or valving member 246 of the tool body 171 to be opened or closed, also enabling indicator flag 246 to be reset to an original or starting position (see FIG. 56) after it has been tripped or deflected by a dropped plug or ball (see FIG. 57). More toggle switches and more actuators 201-206 are required if there are more plug chambers 190, 192 or well control valves 177, 185.

A primary receiver 198 receives a signal from transmitter 210. The primary receiver 198 then sends a signal to a secondary receiver 199 or 200 which are located respectively above and below swivel 179. Other transmitter and receiver configurations could be used. However, by using one primary receiver 198 on swivel 179, it can then communicate with other "secondary" receivers 199, 200. Receivers 199 and 200 rotate with tool body 171 above (receiver 199) and below (receiver 200) swivel 179. This arrangement enables a receiver 199 or 200 to actuate a controller that is also rotating, such as actuator/controller 201 for kelly valve 177 or controller 203 for kelly valve 185 or controller 204 for the valving member of top plug chamber 190 or controller 205 for the valving member of bottom plug chamber 192 or the controller 206 that resets the flag indicator 246 of sub 194.

Secondary receiver 199 operates electrical actuator 201 to selectively open or close kelly valve 177. Secondary receiver 200 operates electrical actuator 203 to open or close kelly valve 185. Either actuator 201 or 203 can open or close its kelly valve 177 or 185 when under pressure of up to 2200 p.s.i. and in less than 15 seconds. This safety feature can be critical to well operation in the event of a dangerous kick.

Other actuators operate other valves. Actuator 202 opens or closed low torque valve 183. Actuator 204 opens or closes the top plug chamber 190 valving member (e.g., see the plug chambers shown and described in FIGS. 1-33). Actuator 205 opens or closes the bottom plug chamber 192 valving member (e.g., see the plug chambers shown and described in FIGS. 1-33). Actuator 206 resets the flag sub 194 with launch indicator after a plug has been launched. Such a launch indicator is shown and described herein. Each electrical actuator 201, 202, 203, 204, 205, 206 can be purchased as such wirelessly operated devices are commercially available, from Parker (www.parker.com) for example.

Each actuator can be protected with a protective guard. Each receiver can be protected with a housing 209 or a guard (see FIG. 42A). Transmitter 210 can be provided with safety features such as a power switch requiring a key 215, emergency stop 217, clear indicator 216, power switch 215, switch/button 214 and a status light to denote whether or not the transmitter is in fact in wireless communication with the receivers or receiver modules 198, 199, 200. Transmitter 210 can be in the form of a housing or frame 212 having handles 213 for a user.

Figure 37:
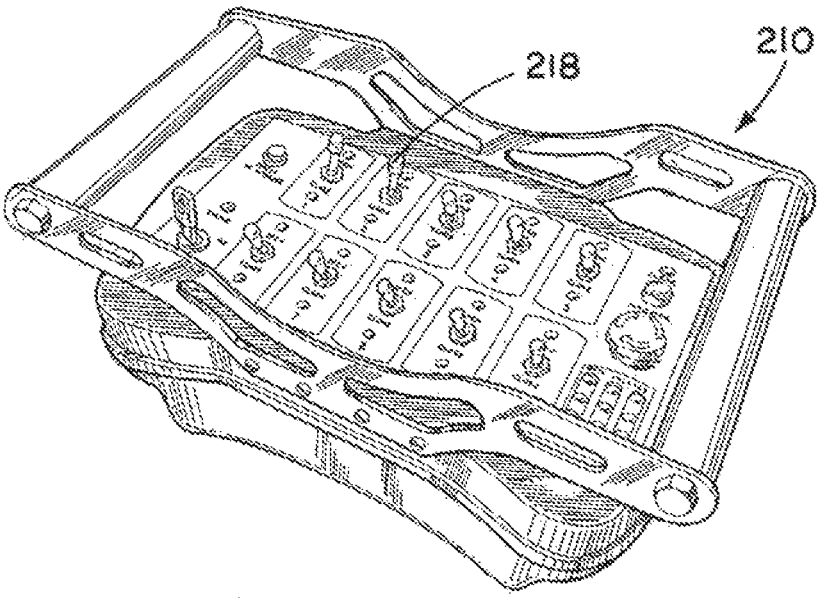
FIG. 37 is a partial perspective view of a fourth embodiment of the apparatus of the present invention, showing the control console.
Figure 38:
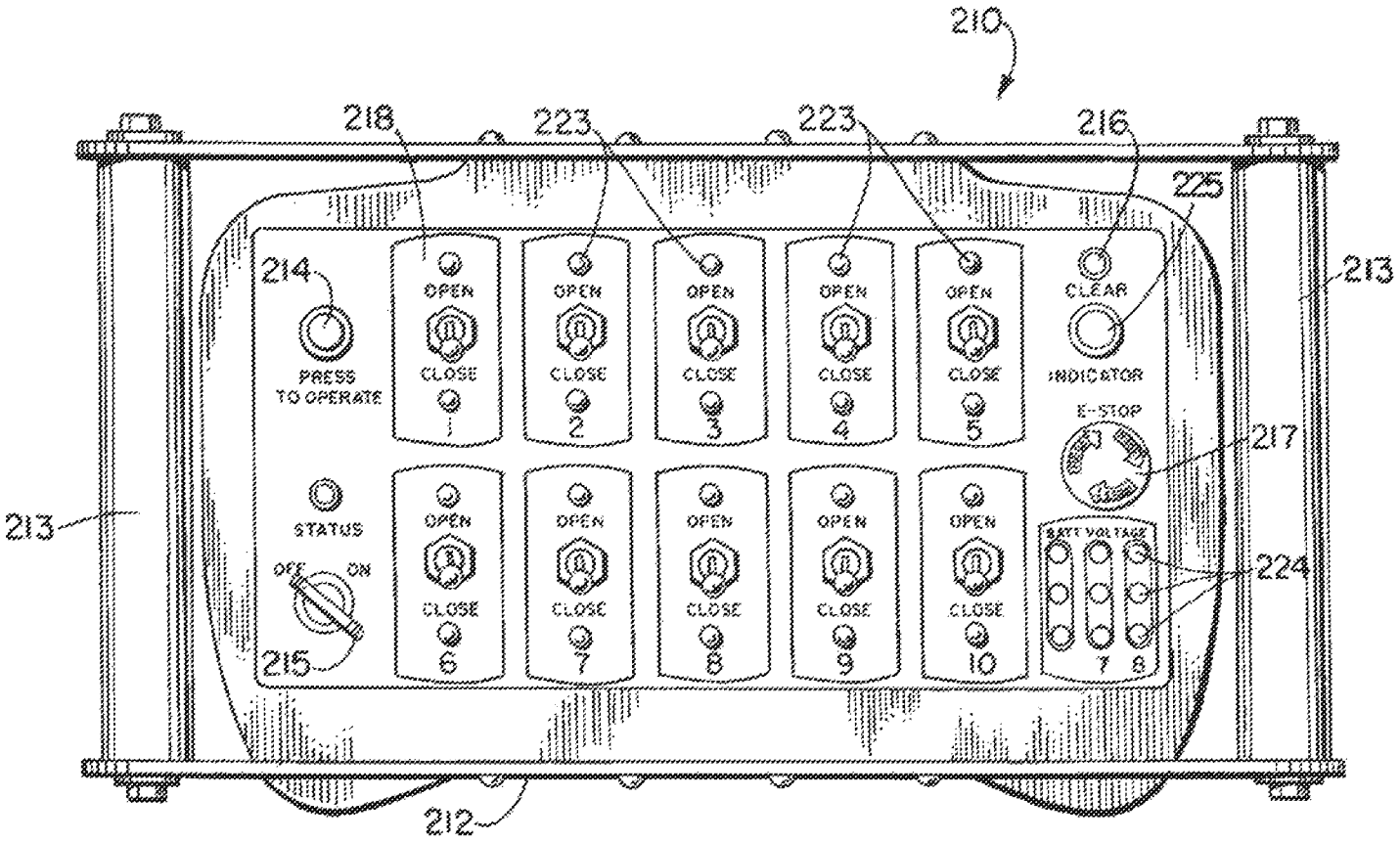
FIG. 38 is a partial plan view of a fourth embodiment of the apparatus of the present invention, showing the central console.
Figure 39:
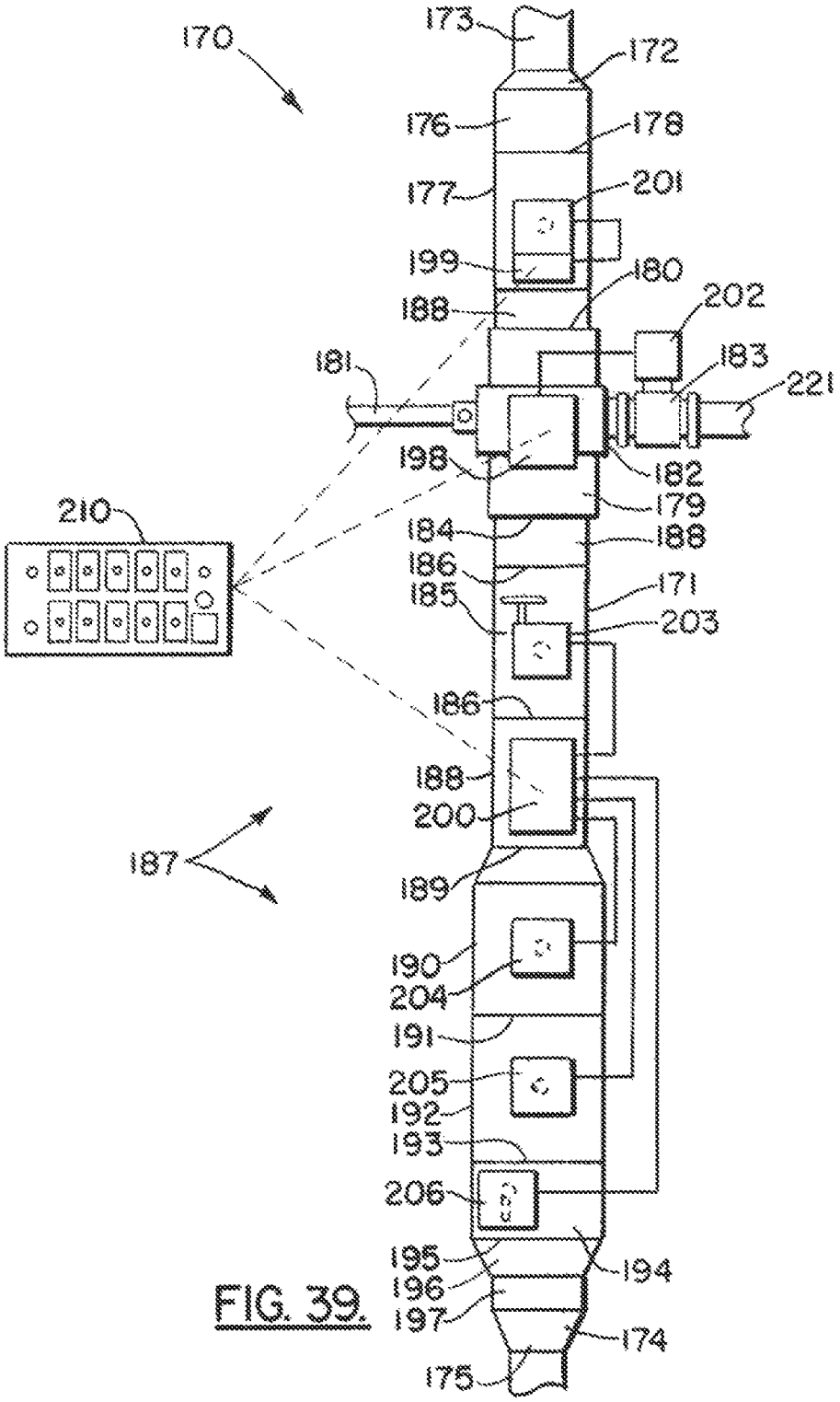
FIG. 39 is a schematic elevation view of a fourth embodiment of the apparatus of the present invention.

In FIGS. 37-38, the transmitter 210 can have features that require duplicity of backup to prevent inadvertent operation. Before transmitter can be operated, a user must rotate emergency stop button 217 (e.g., clockwise) and push and turn key 215 to the "ON" position. These two requirements build in redundancy and thus safety. In addition, operation of any toggle switch 218 can also require simultaneous depression of button 214. Each toggle 218 can have an indicator lamp 223 (e.g. LED) to indicate the correct position of the switch. Before starting operation, a user confirms that each lamp or LED correctly indicates the position of the toggle. Each receiving module 198, 199, 200 can be battery powered. Indicator lamps 224 on the transmitter (lower right corner FIG. 38) can be used to confirm the power level of each battery. Three illuminated lamps can be full power, while one or two lamps indicate less than full power, while no lamps illuminated indicates that a battery has low or no power.

Before operation is allowed the "clear" lamp/indicator 216 must be illuminated which evidences that all LED lamps are extinguished, meaning that all of the toggles 218 are in a neutral position.

A status lamp 225 (e.g., LED) indicates to a user that the transmitter is communicating with the receiver modules 198, 199, 200. Multiple toggles switches 218 can be dedicated to operation of plug or ball or dart dropping valving members. For example, the top row of toggle switches in FIG. 38 could be designated for operating ball, plug, or dart dropping valving members. In FIG. 38, these toggles are numbered 1, 2, 3, 4, 5. These toggles 1, 2, 3, 4, 5 must be operated in sequence (i.e., always drop the most lower ball, dart or plug first). The other toggle switches (bottom row) can be used to operate the kelly valves 177, 185, the low torque cementing inlet control valve 183, the indicator flag sub 194 or any other "on demand" valving member or device. To operate a desired toggle 218, a user must also depress the button 214. Also, the "clear" button 216 must be pressed to confirm that all indicators lamps or LEDs are in the proper position.

Figure 40:
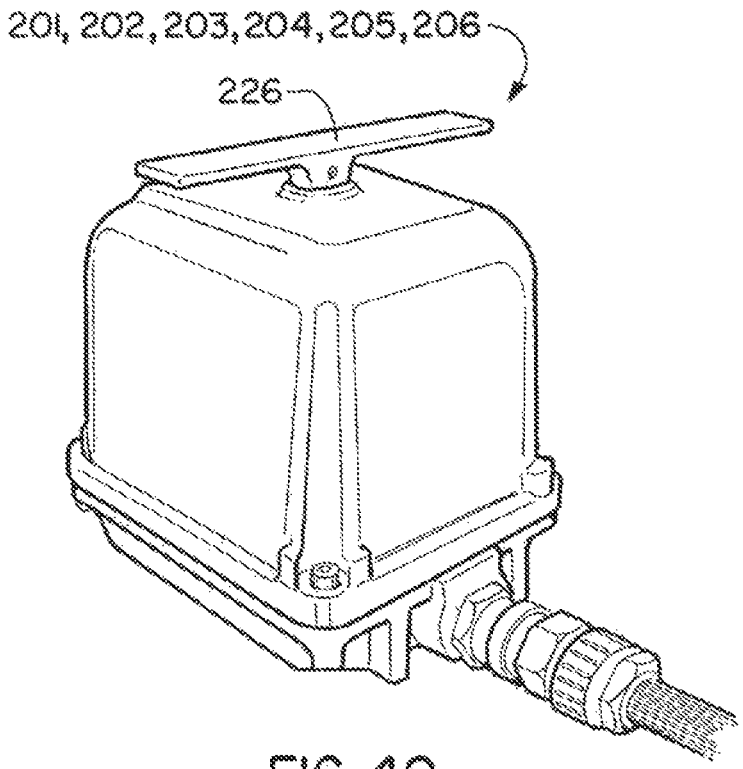
FIG. 40 is a fragmentary perspective view of a fourth embodiment of the apparatus of the present invention, showing an actuator.
Figure 41:
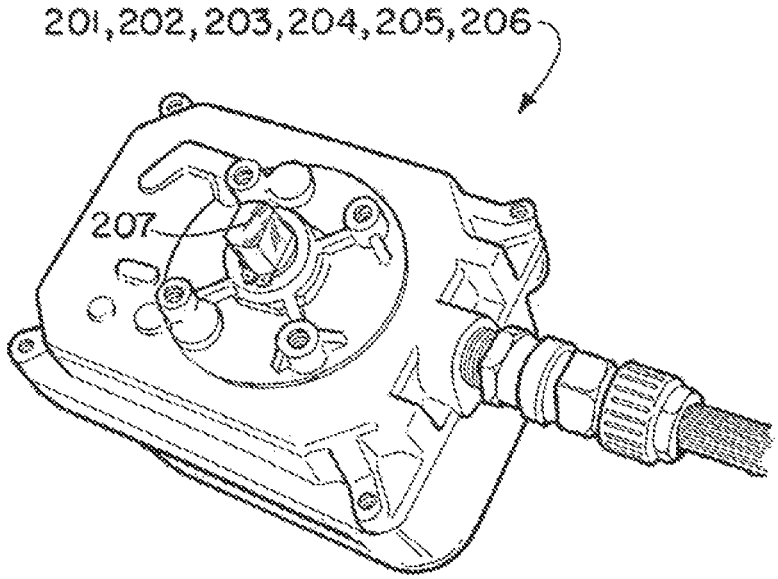
FIG. 41 is a fragmentary perspective view of a fourth embodiment of the apparatus of the present invention, showing an actuator.

Actuators 201-206 can each be equipped with position indicators to indicate whether or not a valving member (e.g., kelly valve 177, 185) is open or closed. Such an indicator can be in the form of a pointer that rotates with the shaped shaft of the actuator 201-206 and labels or visual indications placed so that the pointer registers with the label "open" when the valve (e.g., kelly valve 177, 185) is opened and registers with the label "closed" when the kelly valve or other valve is closed. An actuator 201-206 can be equipped with a manual means (e.g., handle or hand wheel 226) to operate the actuator as seen in FIG. 40. Such hand wheel or handle 226 equipped electrical actuators are commercially available.

Figure 42A:
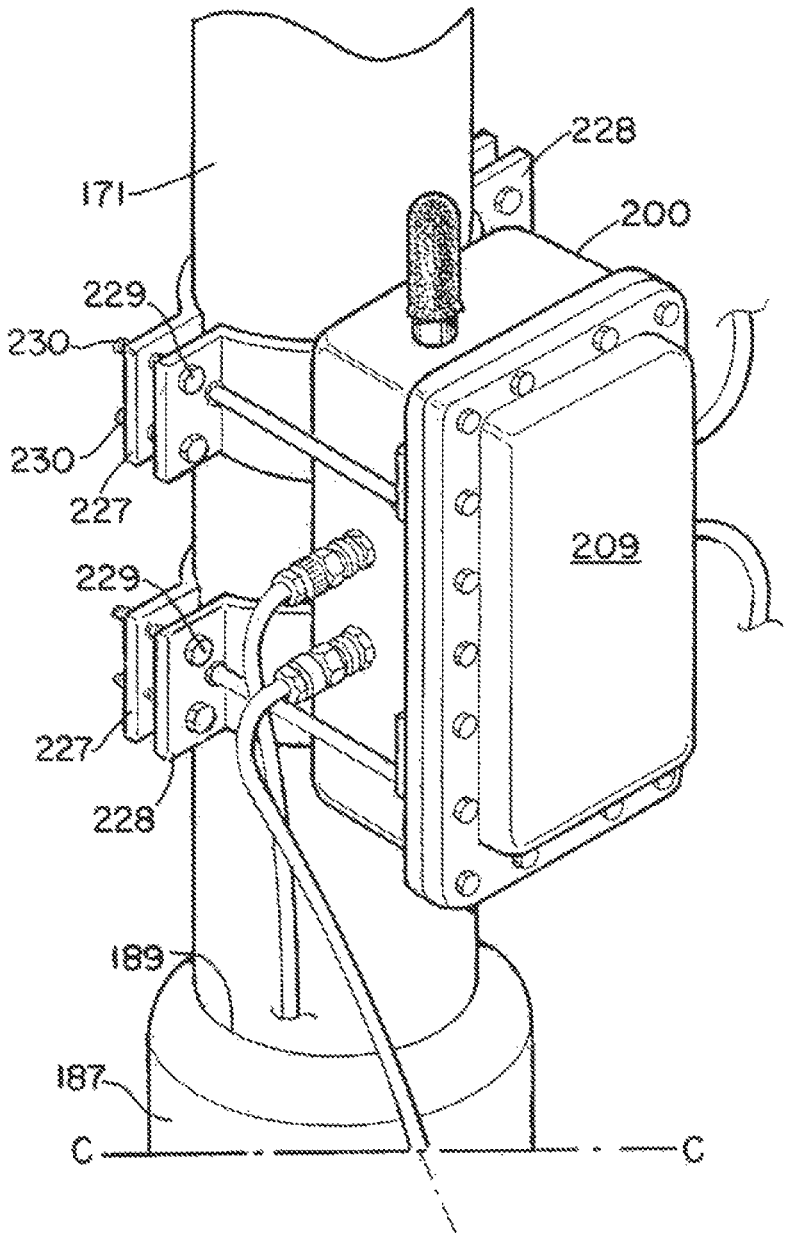
Figure 45:
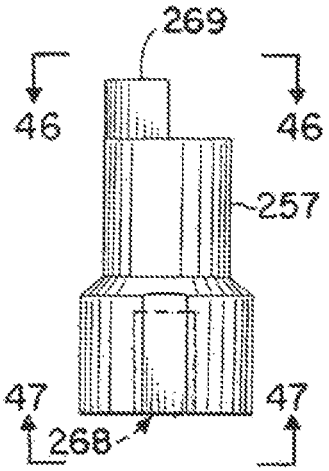
FIG. 45 is a fragmentary view of a fourth embodiment of the apparatus of the present invention.
Figure 46:
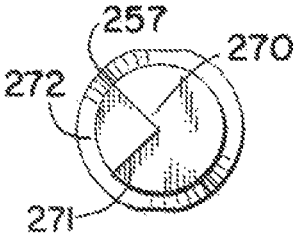
FIG. 46 is a fragmentary view of a fourth embodiment of the apparatus of the present invention.
Figure 47:
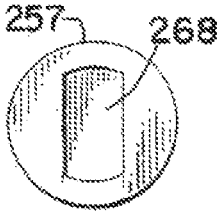
FIG. 47 is a fragmentary view of a fourth embodiment of the apparatus of the present invention.
Figure 48:
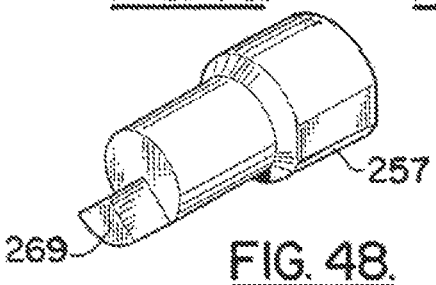
FIG. 48 is a fragmentary view of a fourth embodiment of the apparatus of the present invention.
Figure 49:
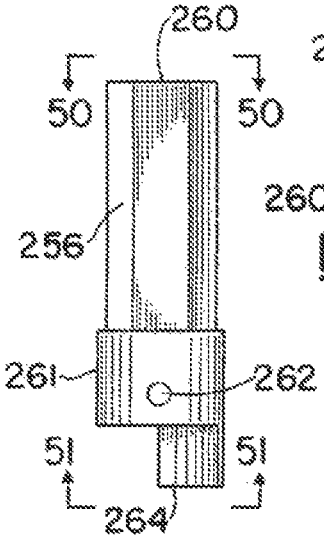
FIG. 49 is a fragmentary view of a fourth embodiment of the apparatus of the present invention.
Figure 50:
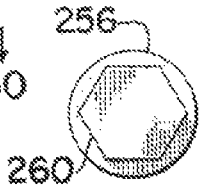
FIG. 50 is a fragmentary view of a fourth embodiment of the apparatus of the present invention.
Figure 51:
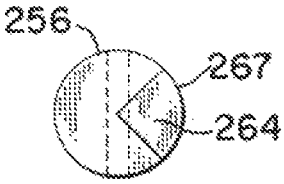
FIG. 51 is a fragmentary view of a fourth embodiment of the apparatus of the present invention.
Figure 52:
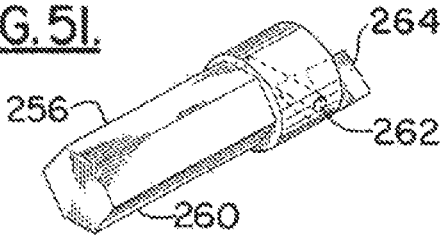
FIG. 52 is a fragmentary view of a fourth embodiment of the apparatus of the present invention.
Figure 53:
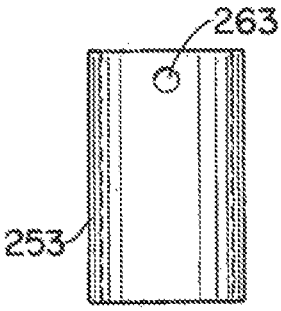
FIG. 53 is a fragmentary view of a fourth embodiment of the apparatus of the present invention.
Figure 54:
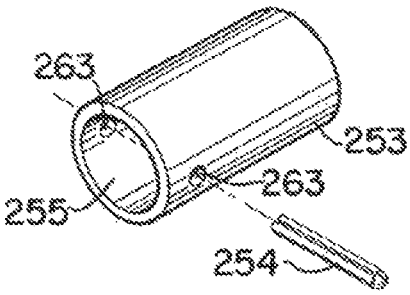
FIG. 54 is a fragmentary exploded view of a fourth embodiment of the apparatus of the present invention.

FIGS. 42B-44 show a typical arrangement for connecting an actuator 201-206 to a valving member such as a kelly valve 177, 185 or a ball dropping valve as one of the ball or plug dropping valves as shown in FIGS. 1-33, 39. In FIGS. 42A-B, a pair of clamp sections 227, 228 can be secured to a selected position on the tool body assembly 171 such as on a safety valve or kelly valve 177, 185. Bolted connections using a bolt 229 and a nut 230 can be used to hold the clamp sections 227, 228 to a safety valve 177, 185.

A hexagonal socket 231 can be used to rotate the valving member of the kelly valve, safety valve or a ball or plug dropping valve such as shown and described with respect to the embodiments of FIGS. 1-33. Valve 177, 185 provides an opening 231 (e.g., hexagonal) that aligns with an opening 232 of clamp section 228 and opening 234 of adaptor 233. The opening 234 in the adaptor 233 can be defined by a bearing or bushing 234 that supports the adaptor 208 shown in FIGS. 43 and 44. Openings 235 in clamp section 228 align with openings 236 of adaptor 233. Fasteners 238 can be used to secure adaptor 233 to clamp section 228 as shown in FIG. 42B. Fasteners 238 extend through openings 236 of adaptor 233 and then into internally threaded openings 235 of clamp section 228. Fasteners 239 can form a threaded connection between adaptor 233 and an actuator 201-205. Openings 237 and adaptor 233 are receptive of fasteners 239. Fasteners 239 would form a threaded connection with an internally threaded opening that is a part of actuator 201-206 such as the actuator 203 shown in FIG. 42B.

Figure 55:
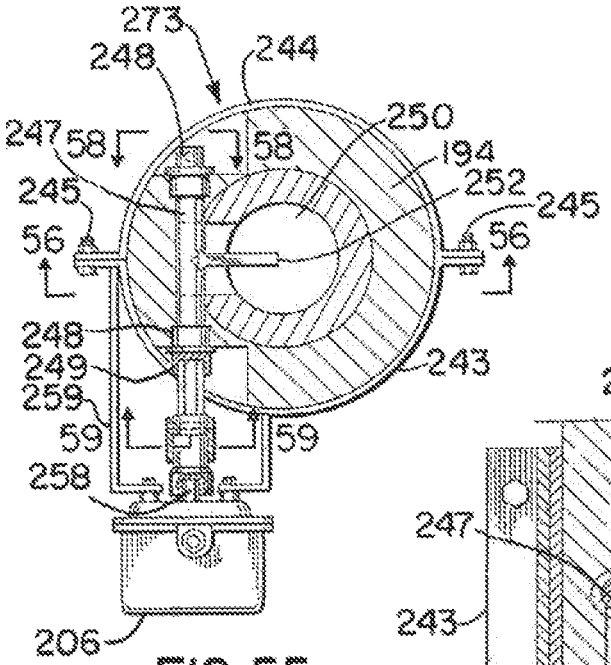
FIG. 55 is a sectional view of a fourth embodiment of the apparatus of the present invention.
Figure 56:
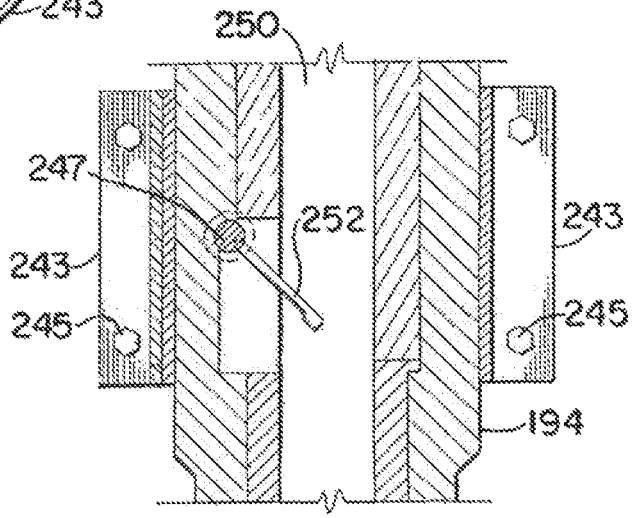
FIG. 56 is a sectional view taken along lines 56-56 of FIG. 55.
Figure 57:
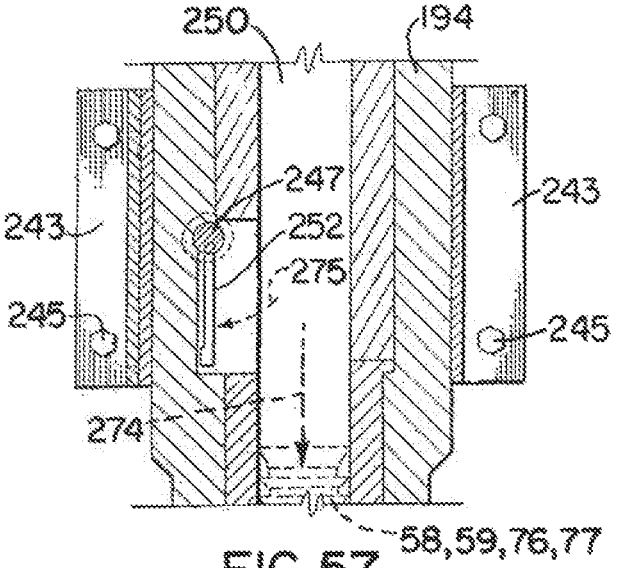
FIG. 57 is a fragmentary sectional view of a fourth embodiment of the apparatus of the present invention.
Figure 58:
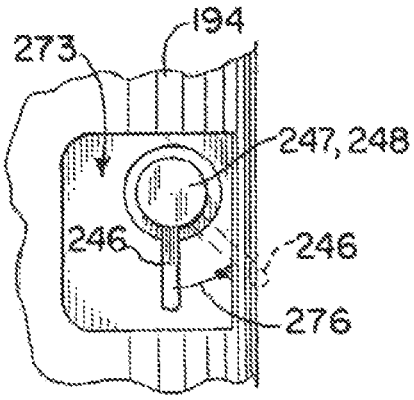
FIG. 58 is a sectional view taken along lines 58-58 of FIG. 55.

Adaptor 208 provides cylindrical surface 240 and hexagonal projecting portion 241. Socket 242 of adaptor 208 enables a connection to be formed with a drive shaft of an actuator 201-205 (commercially available). FIGS. 55-63 show an arrangement for automatically resetting indicator 246 such as a flag indicator. Clamp sections 243, 244 are provided for clamping a housing or guard 259 to indicator sub 194. Bolted connections 245 can be used to hold the clamp sections 243, 244 together. The flag indicator 246 is housed in a recess 273 of indicator sub 194 as shown in FIGS. 55 and 58. When a ball, dart or plug 58, 59, 76, 77 moves downwardly in the direction of arrow 274 in FIG. 57, the ball or dart 58, 59, 76, 77 pushes or rotates lever 252 in the direction of arrow 275 in FIG. 57. This rotation of the lever 252 also rotates the indicator or indicator arm or flag indicator 246 in the direction of arrow 276 in FIG. 58. This shifting of position of the flag indicator 246 from the position shown in hard lines in FIG. 58 to the position shown in phantom lines in FIG. 58 is available to observers and indicates to them that a ball or dart 58, 59, 76, 77 has been dropped successfully.

The present invention provides an automatic mechanism for remotely resetting the flag indicator 246 to the position shown in hard lines in FIG. 58. Thus, the flag indicator 246 can then be used again to indicate whether or not an additional plug or ball 58, 59, 76, 77 has been successfully dropped. In order to rotate the indicator from the tripped or ball dropped position shown in phantom lines in FIG. 58 to the original position, an actuator 206 is provided. The actuator 206 is used to rotate a shaft 247 to which is attached lever 252. This reset position of the lever 252 can be seen in FIGS. 55 and 56. The tripped or triggered position of the lever arm 252 is seen in FIG. 57.

Shaft 247 is supported at its end portions with bearings 248. A connection between the operator 206 and shaft 247 is by means of a sleeve 249 having a hexagonal socket 251 a sleeve 253 forms a connection between a first link 256 and a second link 257. Sleeve 253 provides a sleeve bore 255 and transverse openings 263 that are receptive of a pin 254. Actuator 206 (commercially available) provides a drive shaft 258 that forms a connection with the socket 268 of second link 257. First link 256 provides a hexagonal projection 260 that forms a connection with the hexagonal socket 251 of sleeve 249 (see FIGS. 49-52 and 63).

Figure 59:
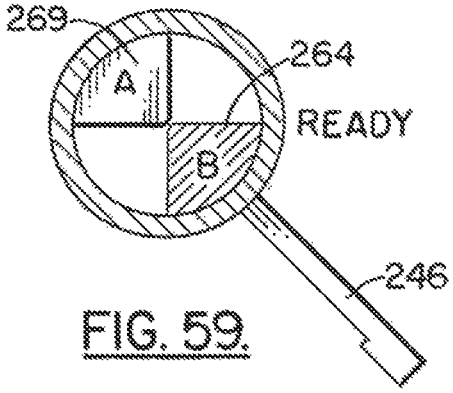
FIG. 59 is a fragmentary schematic view of a fourth embodiment of the apparatus of the present invention.
Figure 60:
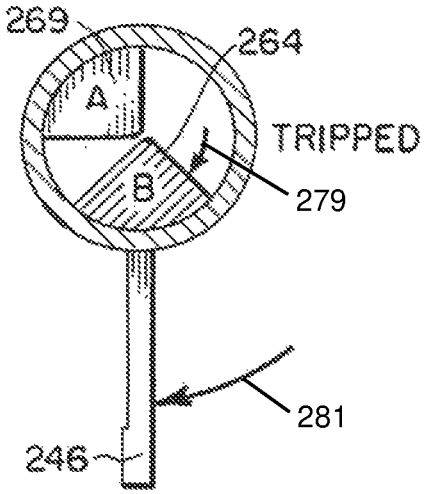
FIG. 60 is a fragmentary schematic diagram of a fourth embodiment of the apparatus of the present invention.
Figure 61:
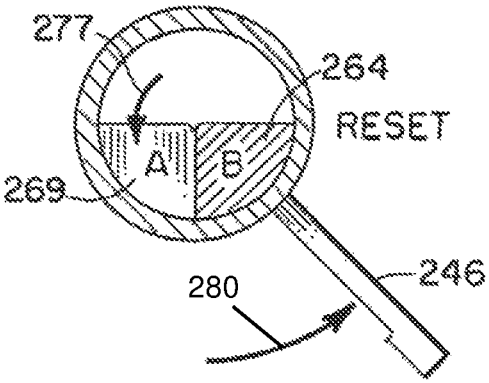
FIG. 61 is a fragmentary schematic diagram of a fourth embodiment of the apparatus of the present invention.
Figure 62:
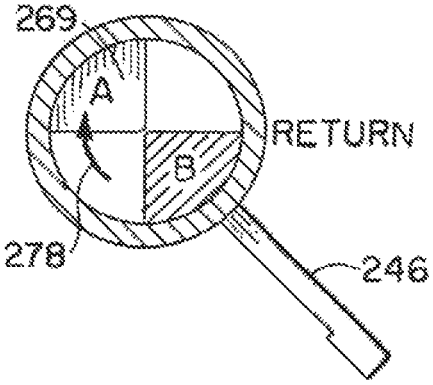
FIG. 62 is a fragmentary schematic diagram of a fourth embodiment of the apparatus of the present invention.
Figure 63:
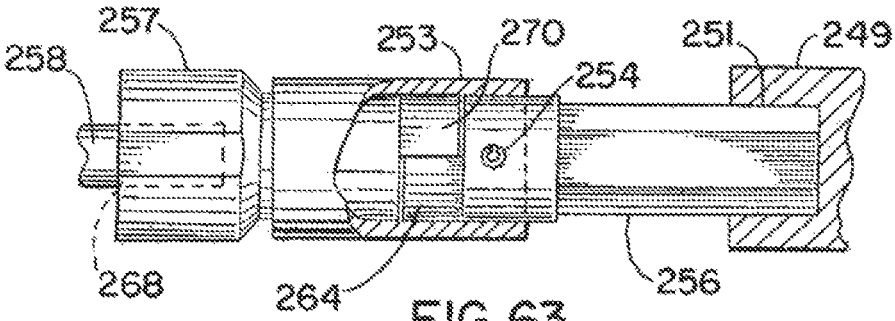
FIG. 63 is a fragmentary view of a fourth embodiment of the apparatus of the present invention.

First link 256 provides a cylindrical portion 261, hexagonal projection 260, and wedge shaped projection 264 as seen in FIGS. 49-52. Transverse bore 262 extends through cylindrical section 261 and is receptive of pin 254. Wedge shaped projection 264 provides flat surface 265, 266 and curved surface 267. Similarly, a wedge shaped projection 269 on second link 257 provides flat surfaces 270, 271 and curved surface 272. FIGS. 59-62 illustrate the positions of the respective wedge shaped projections 264 and 269 of the first and second links 256, 257. In FIGS. 59-62, the wedge shaped projection 264 is labeled with the letter B. The wedge shaped projection 269 is labeled with the letter A. In FIG. 59, the relative positions of the wedge shaped projections 264, 269 is shown in an original starting position and before a ball or plug has been dropped. In FIG. 60, a ball or plug 58, 59, 76, 77 has been dropped, rotating the lever 252 in the direction of arrow 275 in FIG. 57. This action also rotates the shaft 247 which also rotates the first link 256 and its wedge shaped projection 264 in the direction of arrow 279 as shown in FIG. 60. In FIG. 61, the actuator 206 rotates 180 degrees, thus rotating the wedge shaped projection 269 of the second link 257 in the direction of arrow 277 as shown in FIG. 61. This action also rotates the lever 246 in the direction of arrow 280 to its original position of FIG. 59 so that the lever 246 is now ready to receive another ball or plug which will push it in the direction of arrow 281 to the position of FIG. 60 when the ball or plug is dropped as shown in FIG. 57. After the actuator 206 is rotated 180 degrees to reset the lever 246, the actuator 206 is then rotated back to its original position by rotating it 180 degrees in the direction of arrow 278 in FIG. 60 which is the same position shown in FIG. 59.

The following is a list of parts and materials suitable for use in the present invention.

PARTS LIST

| Part Number | Description |
|---|---|
| 10 | oil well drilling structure |
| 11 | platform |
| 12 | derrick |
| 13 | top drive unit |
| 14 | flow line |
| 15 | ball/plug dropping head |
| 16 | string |
| 17 | sea bed/mud line |
| 18 | body of water |
| 19 | water surface |
| 20 | platform deck |
| 21 | lifting device |
| 22 | tubular member |
| 23 | well bore |
| 24 | surface casing |
| 25 | cement/concrete |
| 26 | formation |
| 27 | casing shoe |
| 28 | float valve |
| 29 | passageway |
| 30 | passageway |
| 31 | upper end |
| 32 | liner/production casing |

-continued

PARTS LIST

| Part Number | Description |
|---|---|
| 33 | lower end portion |
| 34 | tool body |
| 35 | section |
| 36 | section |
| 37 | section |
| 38 | section |
| 39 | section |
| 40 | larger diameter ball |
| 41 | dart |
| 42 | smaller diameter ball |
| 43 | first valving member |
| 44 | second valving member |
| 45 | third valving member |
| 46 | threaded connection |
| 47 | threaded connection |
| 48 | threaded connection |
| 49 | threaded connection |
| 50 | threaded portion |
| 51 | flow bore |
| 52 | sleeve |
| 53 | channel |
| 54 | stem |
| 55 | stem |
| 56 | sleeve |
| 57 | sleeve |
| 58 | plug |
| 59 | plug |
| 60 | o-ring |
| 61 | opening position |
| 62 | opening position |
| 63 | opening position |
| 64 | opening position |
| 65 | opening position |
| 66 | opening position |
| 67 | spacer |
| 68 | outer curved surface |
| 69 | flat surface |
| 70 | flat surface |
| 71 | central flow channel |
| 72 | outer flow channel |
| 73 | fin |
| 74 | tool |
| 75 | arrow |
| 76 | upper plug |
| 77 | lower plug |
| 78 | arrows |
| 79 | flow passage |
| 80 | cement |
| 81 | flow passage |
| 82 | arrow |
| 83 | fluid |
| 84 | opening |
| 85 | opening |
| 86 | smaller diameter section |
| 87 | arrow - fluid flow path |
| 88 | fastener |
| 89 | internally threaded opening |
| 90 | opening |
| 91 | fastener |
| 92 | bushing |
| 93 | external threads |
| 94 | sleeve |
| 95 | passageway/bore |
| 96 | fastener |
| 97 | internally threaded opening |
| 98 | opening |
| 99 | pin |
| 100 | arrows |
| 101 | space |
| 102 | frac-ball |
| 110 | ball/plug dropping head |
| 111 | sleeve |
| 112 | valving member |
| 113 | valving member |
| 114 | valve opening |

-continued

PARTS LIST

| Part Number | Description |
|---|---|
| 115 | flat surface |
| 116 | curved surface |
| 117 | flat surface |
| 118 | internal surface |
| 119 | stem |
| 120 | stem |
| 121 | arrow |
| 122 | reference line |
| 123 | beveled edge |
| 124 | arrow |
| 125 | arrow |
| 126 | arrow |
| 127 | arrow |
| 128 | spacer |
| 129 | smaller gap |
| 130 | arrow sleeve movement |
| 131 | annular groove |
| 132 | opening |
| 133 | internally threaded opening |
| 134 | arrow |
| 135 | larger gap |
| 136 | tool body |
| 137 | upper end portion |
| 138 | lower end portion |
| 139 | section |
| 140 | sleeve |
| 141 | cap |
| 142 | threaded connection |
| 143 | opening |
| 144 | tool receptive socket |
| 145 | dart |
| 146 | dart |
| 147 | indicator |
| 148 | shaft |
| 149 | lever arm |
| 150 | pin |
| 151 | spring |
| 152 | arrow |
| 153 | arrow |
| 154 | spring upper end |
| 155 | recess |
| 156 | recess |
| 157 | curved arrow |
| 158 | fastener |
| 159 | slot |
| 160 | insert/sleeve |
| 161 | conical/tapered section |
| 162 | annular shoulder |
| 163 | insert/sleeve |
| 164 | arrow |
| 165 | arrow |
| 166 | arrow |
| 167 | arrow |
| 170 | plug dropping apparatus |
| 171 | tool body assembly |
| 172 | upper end portion |
| 173 | connector |
| 174 | lower end portion |
| 175 | connector |
| 176 | crossover tool |
| 177 | kelly valve/well control safety valve |
| 178 | threaded connection |
| 179 | torque through swivel |
| 180 | connection |
| 181 | torque arm |
| 182 | inlet |
| 183 | low torque valve |
| 184 | connection |
| 185 | kelly valve/well control safety valve |
| 186 | connection |
| 187 | cementing head |
| 188 | sub |
| 189 | connection |
| 190 | top plug chamber |
| 191 | connection |

-continued

PARTS LIST

| Part Number | Description |
|---|---|
| 192 | bottom plug chamber |
| 193 | connection |
| 194 | indicator flag sub |
| 195 | connection |
| 196 | sub |
| 197 | bottom crossover to casing/pipe |
| 198 | primary receiver |
| 199 | secondary receiver |
| 200 | secondary receiver |
| 201 | actuator/controller |
| 202 | actuator/controller |
| 203 | actuator/controller |
| 204 | actuator/controller |
| 205 | actuator/controller |
| 206 | actuator/controller |
| 207 | shaped drive shaft |
| 208 | adapter |
| 209 | housing |
| 210 | transmitter |
| 211 | guard |
| 212 | frame/housing |
| 213 | handle |
| 214 | switch/button |
| 215 | power switch/key |
| 216 | clear indicator |
| 217 | emergency stop |
| 218 | toggle switch |
| 219 | swivel bore |
| 220 | cement pump |
| 221 | hose/pipe |
| 222 | fitting/reducer |
| 223 | indicator lamp |
| 224 | indicator lamp |
| 225 | status lamp |
| 226 | handle/hand wheel |
| 227 | clamp section |
| 228 | clamp section |
| 229 | bolt |
| 230 | nut |
| 231 | hexagonal socket |
| 232 | opening |
| 233 | adapter |
| 234 | bearing/bushing |
| 235 | opening |
| 236 | opening |
| 237 | opening |
| 238 | bolt/fastener |
| 239 | bolt/fastener |
| 240 | cylindrical surface |
| 241 | hexagonal projection |
| 242 | socket |
| 243 | clamp section |
| 244 | clamp section |
| 245 | bolted connection |
| 246 | flag indicator/indicator |
| 247 | shaft |
| 248 | bearing |
| 249 | sleeve |
| 250 | bore |
| 251 | hexagonal socket |
| 252 | lever |
| 253 | sleeve |
| 254 | pin |
| 255 | sleeve bore |
| 256 | first link |
| 257 | second link |
| 258 | actuator shaft/drive shaft |
| 259 | guard/housing |
| 260 | hexagonal projection |
| 261 | cylindrical section |
| 262 | transverse bore |
| 263 | opening |
| 264 | wedge shaped projection |
| 265 | flat surface |
| 266 | flat surface |

-continued

| PARTS LIST | |
|---|---|
| Part Number | Description |
| 267 | curved surface |
| 268 | socket |
| 269 | wedge shaped projection |
| 270 | flat surface |
| 271 | flat surface |
| 272 | curved surface |
| 273 | recess |
| 274 | arrow |
| 275 | arrow |
| 276 | arrow |
| 277 | arrow |
| 278 | arrow |
| 279 | arrow |
| 280 | arrow |
| 281 | arrow |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A ball and plug dropping head for use in sequentially dropping one or more balls and plugs into a well tubing, comprising:

a) a tool body assembly having an inlet at a tool body upper end portion adapted to be fluidly connected in line with the lower end of a top drive, an outlet at a tool body lower end portion that is generally aligned with the inlet;

b) a flow channel that connects the inlet and the outlet;

c) the tool body having a swivel having a cement inlet, a rotating portion and a non-rotating portion;

d) the tool body having a plurality of valves spaced between the inlet and the outlet, each valve having a flow bore, and each valve having a valving member that is movable between open and closed positions, at least one said valve being positioned below the swivel;

e) one or more flow channels that are configured to enable fluid to bypass the valving members when a valving member is in the closed position;

f) wherein fluid flow flows around the valving member when it is in the closed position and through the valving member when it is in the open position;

g) wherein in the open position each valving member permits a ball or plug to pass therethrough, and circulating fluid to pass downwardly therethrough when neither a ball nor plug is in the flow bore;

h) a plurality of said valves having electrical actuators that enable movement of the valving member between open and closed positions;

i) a transmitter having switches that when switched, send a wireless signal to the tool body assembly that enables a selected valving member to be moved to said open or said closed position;

j) the tool body having receivers electrically interfaced with the actuators, at least one said receiver being positioned above the rotating portion of the swivel and at least one said receiver being positioned below said rotating portion of said swivel; and k) the tool body having at least one well control safety valve that is movable between open flow and closed flow positions and wherein it is not one of said valves having a fluid flow channel that enables fluid to bypass the said safety valve when the safety valve is in a closed flow position.

2. The ball and plug dropping head of claim 1, wherein said well control safety valve is a kelly valve.

3. The ball and plug dropping head of claim 1, wherein there are at least two of said well control safety valves.

4. The ball and plug dropping head of claim 2, wherein said well control safety valve is positioned above the swivel.

5. The ball and plug dropping head of claim 2, wherein said well control safety valve is positioned below the swivel.

6. The ball and plug dropping head of claim 3, wherein said one well control safety valve is positioned above the swivel and the other said well control safety valve is below the swivel.

7. The ball and plug dropping head of claim 1, wherein the well control safety valve can be moved from the open to the closed position in a time interval of between about three and fifteen seconds.

8. The ball and plug dropping head of claim 1, wherein the well control safety valve can be closed wherein pressure flowing through the valve is between 100 and 2200 pounds per square inch (p.s.i.).

9. The ball and plug dropping head of claim 1, wherein the receivers include a primary receiver and a pair of secondary receivers, one said secondary receiver positioned above the swivel.

10. The ball and plug dropping head of claim 9, wherein one receiver is positioned above the swivel and one receiver is positioned below the swivel.

11. A ball and plug dropping head for use in sequentially dropping one or more balls and plugs into a well tubing, comprising:

a) a tool body assembly having an inlet at a tool body upper end adapted to be fluidly connected in line with the lower end of a top drive, an outlet generally aligned with the inlet;

b) a main flow channel that connects the inlet and the outlet;

c) the tool body having a swivel having a cement inlet, the swivel having a rotating and a non-rotating portion;

d) the tool body having a plurality of valves spaced between the inlet and the outlet, each valve having a flow bore, and a valving member that is movable between open and closed positions, at least one said valve being positioned below the swivel;

e) one or more fluid flow channels that enable fluid to bypass the valving members when a valving member is in the closed position;

f) wherein fluid flow in the main channel flows around the valving member when it is in the closed position and through the valving member when it is in the open position;

g) wherein in the open position each valve flow bore permits a ball or plug to pass therethrough, and circulating fluid to pass downwardly therethrough when neither a ball nor plug is in the valve flow bore;

h) a plurality of said valving members having electrical actuators that enable movement of the valving member between open and closed positions;

i) a transmitter having switches that when switched, send a wireless signal to the tool body assembly that enables a selected valve to be opened or closed; and j) the tool body having receivers electrically interfaced with the actuators, at least one said receiver being positioned above the rotating portion of the swivel and at least one said receiver being positioned below said rotating portion of said swivel.

12. The ball and plug dropping head of claim 11, wherein one of said valves is a well control safety valve.

13. The ball and plug dropping head of claim 12, wherein there are at least two of said well control safety valves.

14. The ball and plug dropping head of claim 13, wherein one well control safety valve is positioned above the swivel and another well control safety valve is below the swivel.

15. The ball and plug dropping head of claim 12, wherein the well control safety valve is positioned above the swivel.

16. The ball and plug dropping head of claim 12, wherein the well control safety valve is positioned below the swivel.

17. The ball and plug dropping head of claim 12, wherein the well control safety valve can be moved from the open to the closed position in a time interval of between about three and fifteen seconds.

18. The ball and plug dropping head of claim 12, wherein the well control safety valve can be closed wherein the pressure flowing through the valve is between 100 and 2200 pounds per square inch (p.s.i.).

19. The ball and plug dropping head of claim 11, wherein the receivers include a primary receiver and a pair of secondary receivers, one above the swivel.

20. The ball and plug dropping head of claim 19, wherein one receiver is above the swivel and one receiver is below the swivel.

* * * * *